US009501033B2

(12) United States Patent
Abe et al.

(10) Patent No.: US 9,501,033 B2
(45) Date of Patent: Nov. 22, 2016

(54) IMAGE FORMING APPARATUS PROVIDED WITH LIGHT GUIDE AND LIGHT SOURCE

(71) Applicant: BROTHER KOGYO KABUSHIKI KAISHA, Nagoya-shi, Aichi-ken (JP)

(72) Inventors: Koji Abe, Nagoya (JP); Yasuo Fukamachi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/671,242

(22) Filed: Mar. 27, 2015

(65) Prior Publication Data

US 2015/0277359 A1 Oct. 1, 2015

(30) Foreign Application Priority Data

Mar. 31, 2014 (JP) ..... 2014-071830
Mar. 31, 2014 (JP) ..... 2014-071831

(51) Int. Cl.
*G03G 21/00* (2006.01)
*G03G 21/18* (2006.01)
*G03G 21/06* (2006.01)
(Continued)

(52) U.S. Cl.
CPC ..... *G03G 21/1814* (2013.01); *G03G 21/0094* (2013.01); *G03G 21/06* (2013.01); *G03G 21/08* (2013.01); *G03G 21/1671* (2013.01); *G03G 21/1817* (2013.01); *G03G 2221/1853* (2013.01)

(58) Field of Classification Search
CPC .. G03G 21/1671; G03G 21/06; G03G 21/08; G03G 21/0094; G03G 21/1814; G03G 21/1817; G03G 2221/1853
See application file for complete search history.

(56) References Cited

U.S. PATENT DOCUMENTS

2002/0081126 A1* 6/2002 Yokomori ..... G03G 21/1814 399/118
2006/0060751 A1* 3/2006 Nishimura ..... G03G 21/08 250/208.1
2008/0193163 A1* 8/2008 Moon ..... G03G 21/08 399/128

(Continued)

FOREIGN PATENT DOCUMENTS

JP 1-88970 U 6/1989
JP 2002-1 89400 A 7/2002

(Continued)

OTHER PUBLICATIONS

Related U.S. Appl. No. 14/671,625, filed Mar. 27, 2015.

(Continued)

*Primary Examiner* — Ryan Walsh
(74) *Attorney, Agent, or Firm* — Merchant & Gould P.C.

(57) ABSTRACT

An image forming apparatus includes: a main casing; a light source; and a photosensitive cartridge. The light source is provided in the main casing and configured to emit a light. The photosensitive cartridge is mountable in the main casing in a mounting direction. The photosensitive cartridge includes: a photosensitive drum; a light guide; a first wall and a second wall. The photosensitive drum has a surface. The light guide is configured to guide the light emitted from the light source to the surface of the photosensitive drum to eliminate static on the surface of the photosensitive drum. The second wall is spaced apart from the first wall in a first direction that crosses the mounting direction. The light source is disposed between the first wall and the second wall when the photosensitive cartridge has been mounted in the main casing.

29 Claims, 15 Drawing Sheets

(51) Int. Cl.

| | |
|---|---|
| ***G03G 21/16*** | (2006.01) |
| ***G03G 21/08*** | (2006.01) |

(56) References Cited

U.S. PATENT DOCUMENTS

| | | | | |
|---|---|---|---|---|
| 2009/0324287 | A1* | 12/2009 | Okabe | G03G 21/08 399/128 |
| 2010/0080623 | A1* | 4/2010 | Tanaka | G03G 21/08 399/118 |
| 2010/0278571 | A1* | 11/2010 | Abe | G03G 21/0058 399/357 |
| 2011/0020034 | A1* | 1/2011 | Tsutsumi | G03G 21/08 399/128 |
| 2011/0129254 | A1* | 6/2011 | Oda | G03G 21/0094 399/128 |
| 2011/0243609 | A1 | 10/2011 | Takami et al. | |
| 2012/0201561 | A1* | 8/2012 | Kubo | G03G 21/06 399/89 |
| 2013/0195488 | A1* | 8/2013 | Hatano | G03G 15/0189 399/66 |
| 2015/0023696 | A1* | 1/2015 | Hayashi | G03G 21/0005 399/128 |
| 2015/0030351 | A1* | 1/2015 | Wakayama | G03G 21/08 399/128 |
| 2015/0277359 | A1 | 10/2015 | Abe et al. | |
| 2015/0277360 | A1* | 10/2015 | Abe | G03G 21/1671 399/128 |

FOREIGN PATENT DOCUMENTS

| | | | |
|---|---|---|---|
| JP | 2002-278395 | A | 9/2002 |
| JP | 2005-275130 | A | 10/2005 |
| JP | 2006-91332 | A | 4/2006 |
| JP | 2006-154619 | A | 6/2006 |
| JP | 2006-276529 | A | 10/2006 |
| JP | 2009-243629 | A | 10/2009 |
| JP | 2011-64711 | A | 3/2011 |
| JP | 2011-227425 | A | 11/2011 |

OTHER PUBLICATIONS

U.S. Office Action issued in related U.S. Appl. No. 14/671,625 mailed Oct. 19, 2015.

U.S. Office Action (Notice of Allowance) issued in related U.S. Appl. No. 14/671,625, mailed Feb. 24, 2016.

* cited by examiner

TOP
BOTTOM
LEFT
RIGHT
18
71
72
37
36B
(36,313)
333
310
320
317
331
321
C
C
311
70
302
390

TOP
BOTTOM
FRONT
REAR
D
D
18
70
70A
37
72
36B(36)
99
333
319
323
98
325
318
116
96
97
324
392
390
315
321
312
331
317
310
320

RIGHT
LEFT
18
71
72
70
70A
37
36B(36)
99
323
318
320
325
333
319
97
98
323
392
396
322B
310
314
322
322A
312
315
331
322
321
322A
390
314
322B
317

IMAGE FORMING APPARATUS PROVIDED WITH LIGHT GUIDE AND LIGHT SOURCE

CROSS REFERENCE TO RELATED APPLICATION

This application claims priority from Japanese Patent Application Nos. 2014-071830 filed Mar. 31, 2014; and 2014-071831 filed Mar. 31, 2014. The entire content of each of the priority applications is incorporated herein by reference.

TECHNICAL FIELD

The present disclosure relates to an image forming apparatus that employs an electrophotographic system.

BACKGROUND

One conventional electrophotographic image forming apparatus is a printer that includes a main casing; a drum unit that is detachably mounted in the main casing and provided with a photosensitive drum and a charger; a developing cartridge that is detachably mounted in the drum unit and provided with a developing roller; and an exposure device that exposes the photosensitive drum.

In this type of printer, the charger first applies charge to a surface of the photosensitive drum, after which the exposure device selectively removes charge from the surface of the photosensitive drum to form an electrostatic latent image thereon. Next, the developing roller supplies toner to the electrostatic latent image on the photosensitive drum to form a toner image thereon. The toner image is then transferred from the surface of the photosensitive drum onto paper to form an image on the paper.

However, occasionally electric charge that remains on the surface of the photosensitive drum after a toner image has been transferred from the photosensitive drum to paper affects the next electrostatic latent image formed on the surface of the photosensitive drum, leading to poor image formation quality. Therefore, studies have been conducted on how to remove electric charge from the surface of the photosensitive drum.

For example, one printer that has been proposed includes a rod-like light guide that is supported in a drum unit so as to be opposite a surface of a photosensitive drum while extending in a left-right direction, and a light source disposed in a main casing on the right side of the light guide.

In a printer having this construction, light emitted from the light source enters the light guide through its right endface and is guided by the light guide to be irradiated onto the surface of the photosensitive drum. This irradiated light removes any residual charge from the surface of the photosensitive drum.

SUMMARY

However, paper dust, toner particles, and the like are often scattered throughout the main casing of the printer described above when the printer performs an image-forming operation. This scattered toner particles, paper dust, and the like can become deposited on and contaminate the light source.

Toner particles, paper dust, and the like that become deposited on the light source can obstruct light traveling from the light source toward the light guide. Consequently, the light may be unable to eliminate charge sufficiently from the photosensitive drum.

In view of the foregoing, it is an object of the disclosure to provide an image forming apparatus that can suppress contamination of a light source and, hence, an emitting part.

Further, in the printer described above, the light source is supported in the main casing while the light guide is supported on the drum unit. Thus, the light guide moves when the drum unit is mounted in and removed from the main casing. Consequently, this arrangement cannot adequately ensure precision in positioning the light guide relative to the light source when the drum unit is mounted in the main casing, leading to light emitted from the light source not being accurately incident on the light guide. In such cases, this configuration cannot adequately remove charge from the photosensitive drum.

In view of the foregoing, it is another object of the disclosure to provide an image forming apparatus that can improve the precision in positioning a light guide and a light source relative to each other.

In order to attain the above and other objects, according to one aspect, the disclosure provides an image forming apparatus that may include: a main casing; a light source; and a photosensitive cartridge. The light source may be provided in the main casing and may be configured to emit a light. The photosensitive cartridge may be configured to be mounted in the main casing in a mounting direction. The photosensitive cartridge may include: a photosensitive drum; a light guide; a first wall, and a second wall. The photosensitive drum may have a surface. The light guide may be configured to guide the light emitted from the light source to the surface of the photosensitive drum to eliminate static on the surface of the photosensitive drum. The second wall may be spaced apart from the first wall in a first direction that crosses the mounting direction. The light source may be disposed between the first wall and the second wall when the photosensitive cartridge has been mounted in the main casing.

According to another aspect, the disclosure provides an image forming apparatus that may include: a main casing; a light source; a photosensitive cartridge; and a cover member. The light source may be provided in the main casing and may include: an emitting part configured to emit a light in an emission direction; and a support part configured to support the emitting part. The photosensitive cartridge may be configured to be mounted in the main casing in a mounting direction. The photosensitive cartridge may include: a photosensitive drum; a light guide; and a cartridge frame. The photosensitive drum may have a surface. The light guide may be configured to guide the light emitted from the emitting part to the surface of the photosensitive drum to eliminate static on the surface of the photosensitive drum. The cartridge frame may be configured to support the photosensitive drum. The cover member may be provided separately from the main casing and the photosensitive cartridge. The cover member may be positioned to surround the emitting part as viewed in the emission direction. The cover member may be configured to contact both the support part and the cartridge frame to seal a gap between the support part and the cartridge frame when the photosensitive cartridge has been mounted in the main casing.

According to still another aspect, the disclosure provides an image forming apparatus that may include: a main casing; a light source; and a photosensitive cartridge. The light source may be provided in the main casing and may be configured to emit a light. The photosensitive cartridge may be configured to be mounted in the main casing in a mounting direction. The photosensitive cartridge may include: a first engaging part; a photosensitive drum; and a light guide. The photosensitive drum may extend in an orthogonal direction that is orthogonal to the mounting direction. The photosensitive drum may have a surface. The light guide may be configured to guide the light emitted from the light source to the surface of the photosensitive drum to eliminate static on the surface of the photosensitive drum. The light source may be configured to move in the orthogonal direction. The light source may be disposed downstream of the light guide in the mounting direction when the photosensitive cartridge has been mounted in the main casing. The light source may include a second engaging part configured to engage with the first engaging part when the photosensitive cartridge is mounted in the main casing. The first engaging part may be configured to restrict the movement of the light source in the orthogonal direction upon engagement with the second engaging part to fix relative positions between the light guide and the light source.

According to still another aspect, the disclosure provides an image forming apparatus that may include: a main casing; a light source; and a photosensitive cartridge. The light source may be provided in the main casing and may be configured to emit a light. The photosensitive cartridge may be configured to be mounted in the main casing in a mounting direction. The photosensitive cartridge may include: a photosensitive drum; and a light guide. The photosensitive drum may extend in an orthogonal direction that is orthogonal to the mounting direction. The photosensitive drum may have a surface. The light guide may be configured to guide the light emitted from the light source to the surface of the photosensitive drum to eliminate static on the surface of the photosensitive drum. The light guide may be configured to move in the orthogonal direction and may include a first engaging part. The light source may include a second engaging part configured to engage with the first engaging part when the photosensitive cartridge is mounted in the main casing. The second engaging part may be configured to restrict the movement of the light guide in the orthogonal direction upon engagement with the first engaging part to fix relative positions between the light guide and the light source.

DETAILED DESCRIPTION

1. First Embodiment

Figure 1:
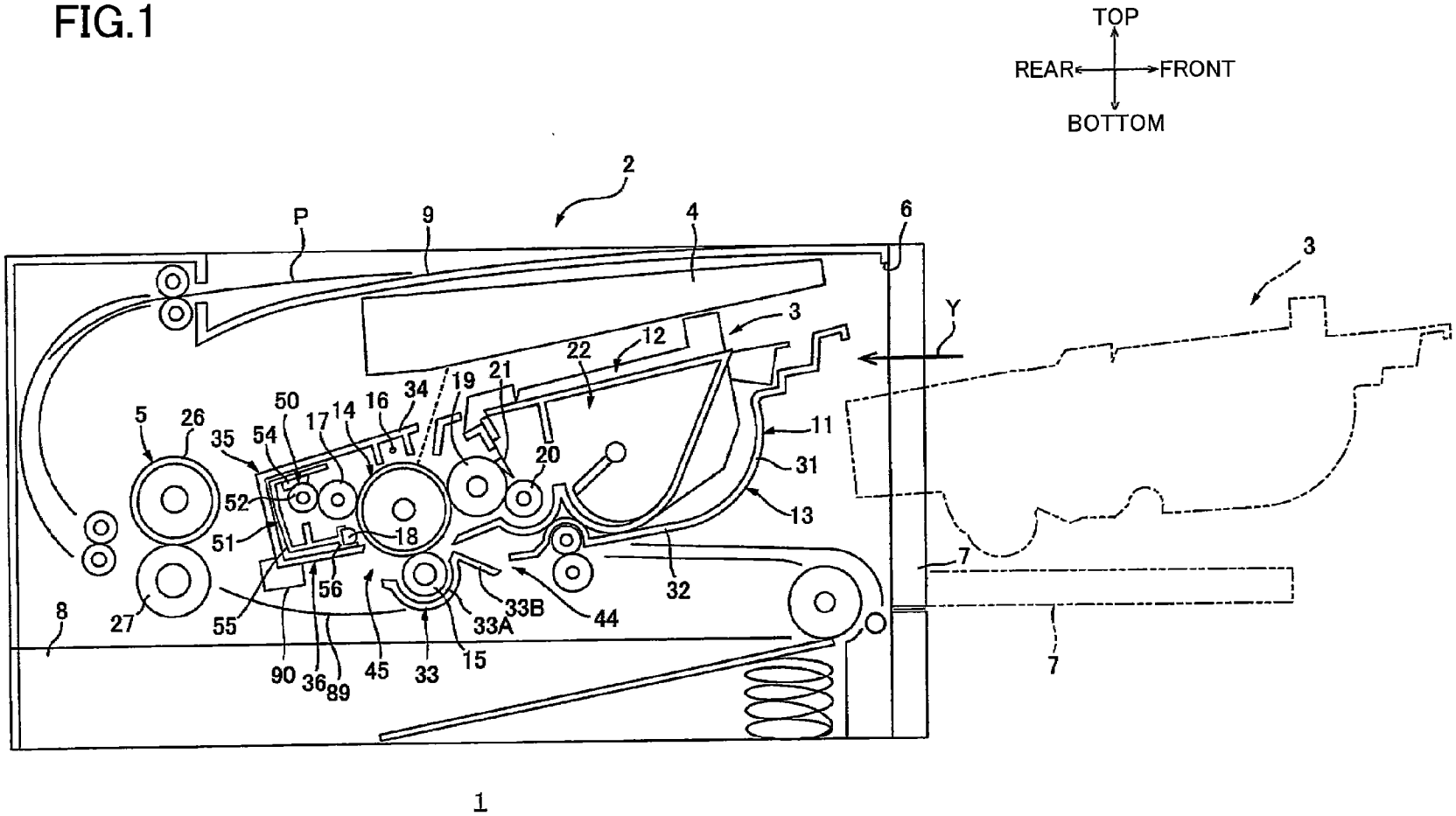
FIG. 1 is a center cross-sectional view of a printer as an image forming apparatus according to a first embodiment of the present invention.

A printer 1 as an image forming apparatus according to a first embodiment of the present invention will be described with reference to FIGS. 1 through 8, wherein like parts and components are designated by the same reference numerals to avoid duplicating description.

<Overview of Printer>

The printer 1 is a monochromatic printer having an electrophotographic system. The printer 1 includes a main casing 2, a process cartridge 3, a scanning unit 4, and a fixing unit 5.

The main casing 2 has a box-like shape. The main casing 2 includes an access opening 6, a front cover 7, a paper tray 8, and a discharge tray 9.

The access opening 6 is formed in one side of the main casing 2. The access opening 6 provides communication between the interior and exterior of the main casing 2 and allows the process cartridge 3 to pass therethrough.

The front cover 7 is provided on the same side of the main casing 2 as the access opening 6. The front cover 7 has a general plate shape and extends vertically when in its closed position. The front cover 7 is supported to the main casing 2 and is capable of pivotally moving about its bottom edge. The front cover 7 can open and close over the access opening 6.

In the following description, the side of the printer 1 on which the front cover 7 is provided will be referred to as a "front" side, while the opposite side will be referred to as a "rear" side. Left and right sides of the printer 1 are defined based on the perspective of a user facing the front of the printer 1. Directional arrows have also been provided in the drawings for reference.

Further, front, rear, left, right, up, and down directions related to a drum cartridge 11 described later are defined based on the mounted state of the drum cartridge 11 in the main casing 2.

Further, the left-right direction is an example of a first direction.

The paper tray 8 is disposed in the bottom section of the main casing 2. The paper tray 8 has a box-like shape that is open on the top and is capable of accommodating sheets P of paper.

The discharge tray 9 is disposed in the approximate front-rear center region on the top surface of the main casing 2. The discharge tray 9 is recessed downward below the top surface of the main casing 2 in order to receive or to support the sheets P.

The process cartridge 3 can be mounted in and removed from the main casing 2 through the access opening 6. When mounted in the main casing 2, the process cartridge 3 is disposed in the approximate center of the main casing 2 in a side view. The process cartridge 3 includes the drum cartridge 11 as an example of a photosensitive cartridge, and a developing cartridge 12. Hence, the drum cartridge 11 can also be mounted in and removed from the main casing 2 since the process cartridge 3 including the drum cartridge 11 can be mounted in and removed from the main casing 2.

The drum cartridge 11 includes a photosensitive drum 14, a transfer roller 15, and a scorotron charger 16.

The photosensitive drum 14 has a general cylindrical shape and is rotatably supported in the rear portion of the drum cartridge 11 with its axis extending in a left-right direction. The transfer roller 15 has a general columnar shape and is disposed beneath the photosensitive drum 14 with its axis extending in the left-right direction. The top surface of the transfer roller 15 is in contact with the bottom surface of the photosensitive drum 14. The scorotron charger 16 is disposed above and spaced apart from the photosensitive drum 14.

The developing cartridge 12 can be mounted in and removed from the drum cartridge 11. When mounted in the drum cartridge 11, the developing cartridge 12 is positioned on the front side of the photosensitive drum 14. The developing cartridge 12 includes a developing roller 19, a supply roller 20, a thickness regulating blade 21, and a toner accommodating section 22.

The developing roller 19 is rotatably supported in the rear portion of the developing cartridge 12. The developing roller 19 has a general columnar shape and is oriented with its axis extending in the left-right direction. The rear surface of the developing roller 19 is in contact with the front surface of the photosensitive drum 14.

The supply roller 20 is disposed on the lower front side of the developing roller 19. The supply roller 20 has a general columnar shape and is rotatably supported in the developing cartridge 12 with its axis extending in the left-right direction. The upper rear surface of the supply roller 20 is in contact with the lower front surface of the developing roller 19.

The thickness regulating blade 21 is disposed on the upper front side of the developing roller 19. The thickness regulating blade 21 contacts the front surface of the developing roller 19.

The toner accommodating section 22 is formed in the developing cartridge 12 on the front side of the supply roller 20 and thickness regulating blade 21. The toner accommodating section 22 functions to accommodate toner.

The scanning unit 4 is disposed in the main casing 2 above the process cartridge 3. The scanning unit 4 functions to irradiate a laser beam toward the photosensitive drum 14 based on image data.

The fixing unit 5 is disposed in the main casing 2 to the rear of the process cartridge 3. The fixing unit 5 includes a heating roller 26, and a pressure roller 27. The pressure roller 27 is positioned beneath the heating roller 26 such that the top surface of the pressure roller 27 contacts the bottom surface of the heating roller 26 with pressure.

The printer 1 performs image-forming operations under control of a control unit (not shown). At the beginning of the image-forming operation, the scorotron charger 16 applies a uniform charge to the surface of the photosensitive drum 14. Next, the scanning unit 4 exposes the surface of the photosensitive drum 14, forming an electrostatic latent image on the surface of the photosensitive drum 14 based on image data.

The supply roller 20 supplies toner from the toner accommodating section 22 onto the developing roller 19. At this time, the toner is positively tribocharged between the developing roller 19 and the supply roller 20 so that the developing roller 19 carries charged toner. The thickness regulating blade 21 regulates the toner carried on the surface of the developing roller 19 at a uniform thickness.

The toner carried on the developing roller 19 is then supplied to the electrostatic latent image formed on the surface of the photosensitive drum 14. As a result, the photosensitive drum 14 carries a toner image on its surface.

In the meantime, various rollers in the printer 1 rotate to feed the sheets P from the paper tray 8 and to supply the sheets P one at a time and at a prescribed timing through a supply opening 44 (described later) to a position between the photosensitive drum 14 and the transfer roller 15.

As the sheet P passes between the photosensitive drum 14 and the transfer roller 15, the toner image carried on the surface of the photosensitive drum 14 is transferred onto the sheet P.

The sheet P subsequently passes through a discharge opening 45 (described later) and is guided by a conveyance guide 89 (described later) to a position between the heating roller 26 and the pressure roller 27. When passing through the fixing unit 5, the heating roller 26 and pressure roller 27 apply heat and pressure to the sheet P, thermally fixing the toner image to the sheet P. Subsequently, various rollers in the printer 1 rotate to discharge the sheet P into the discharge tray 9.

<Detailed Structure of Drum Cartridge>

As shown in FIGS. 2, 3, 4, and 8, the drum cartridge 11 includes a drum frame 13 as an example of a cartridge frame, a cleaning unit 50, a light guide 18, and a film member 49 as an example of a transmissive member, in addition to the photosensitive drum 14, the transfer roller 15, and the scorotron charger 16 described earlier.

(1) Drum Frame

Figure 2:
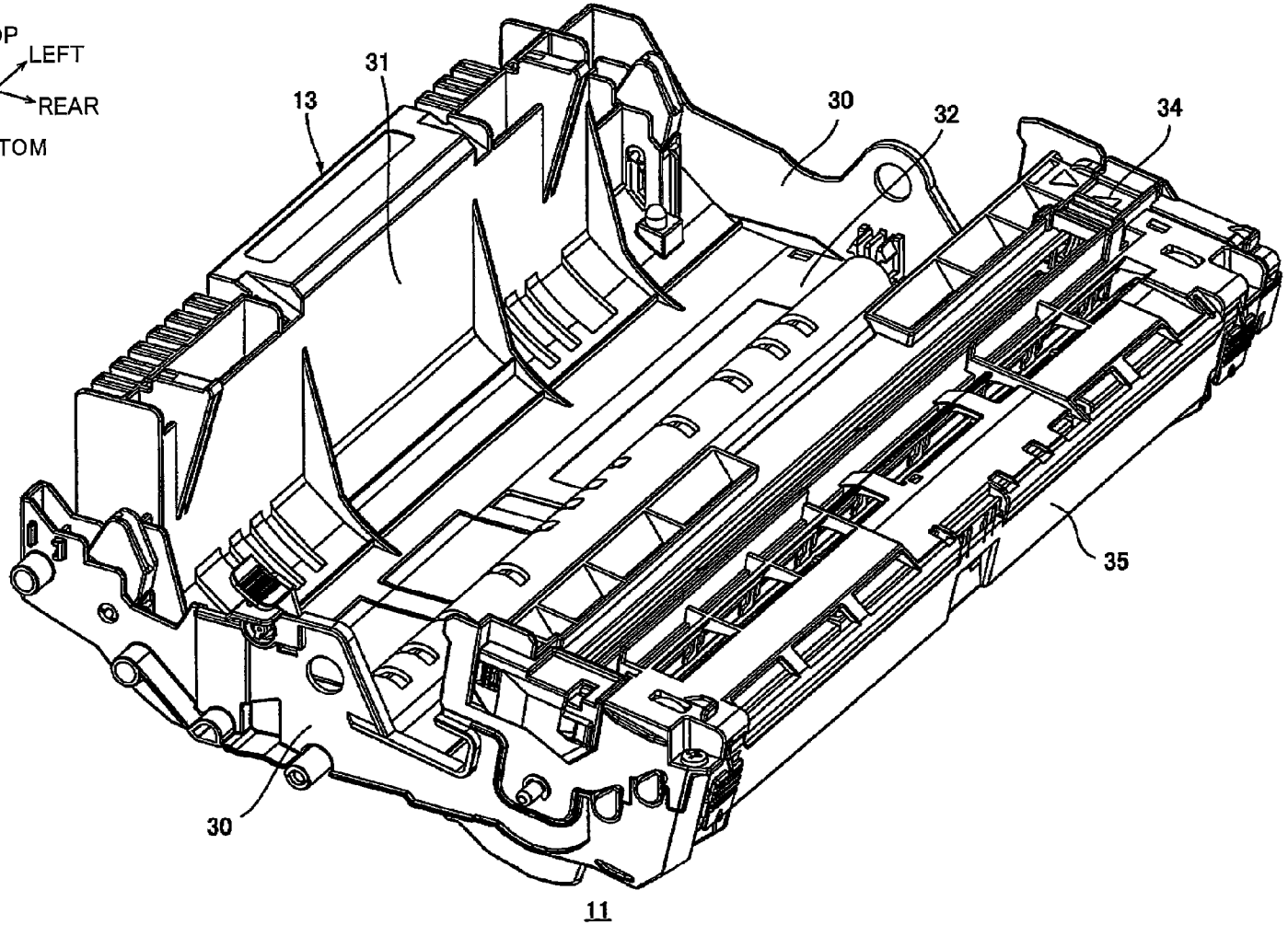
FIG. 2 is a perspective view of a drum cartridge provided in the printer shown in FIG. 1 as viewed from an upper right side thereof.
Figure 3:
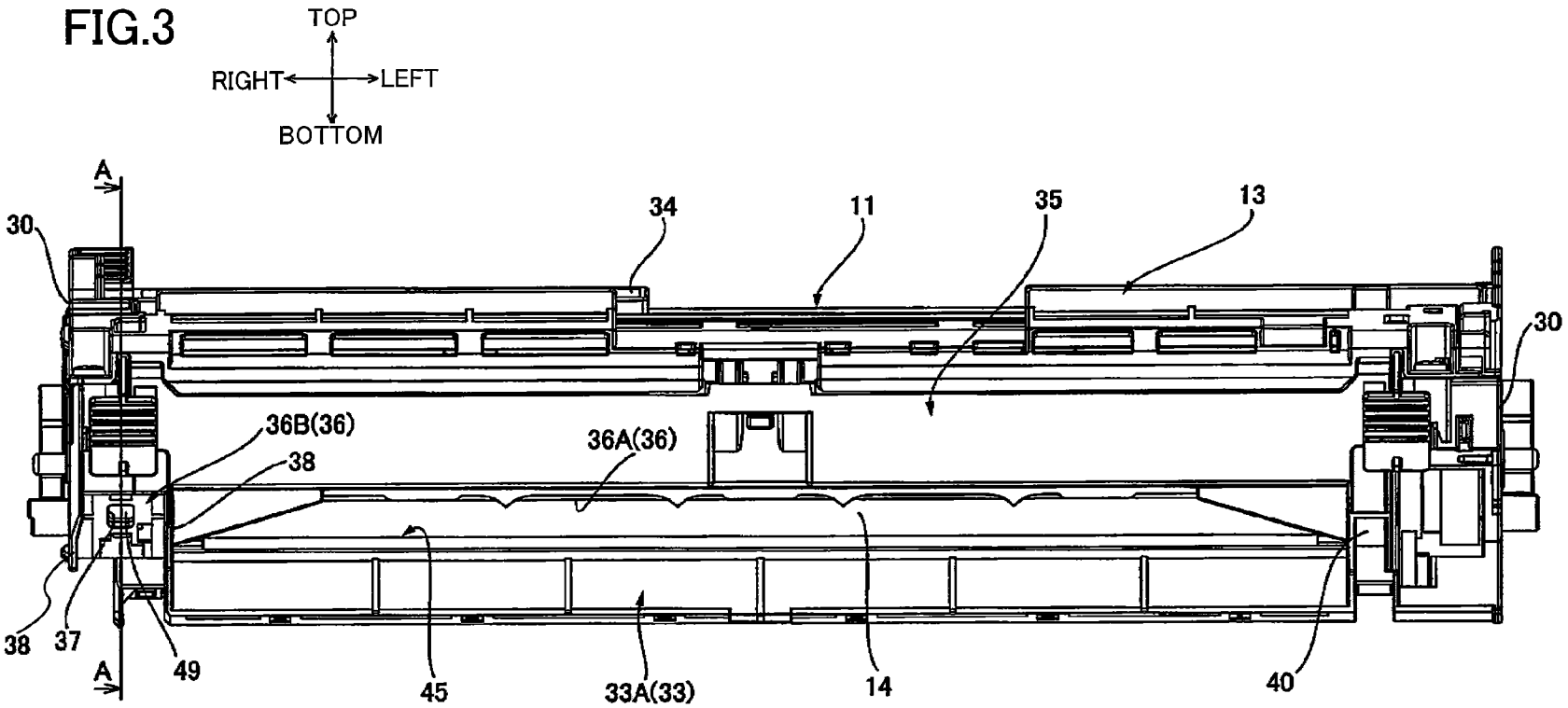
FIG. 3 is a rear view of the drum cartridge shown in FIG. 2.
Figure 4:
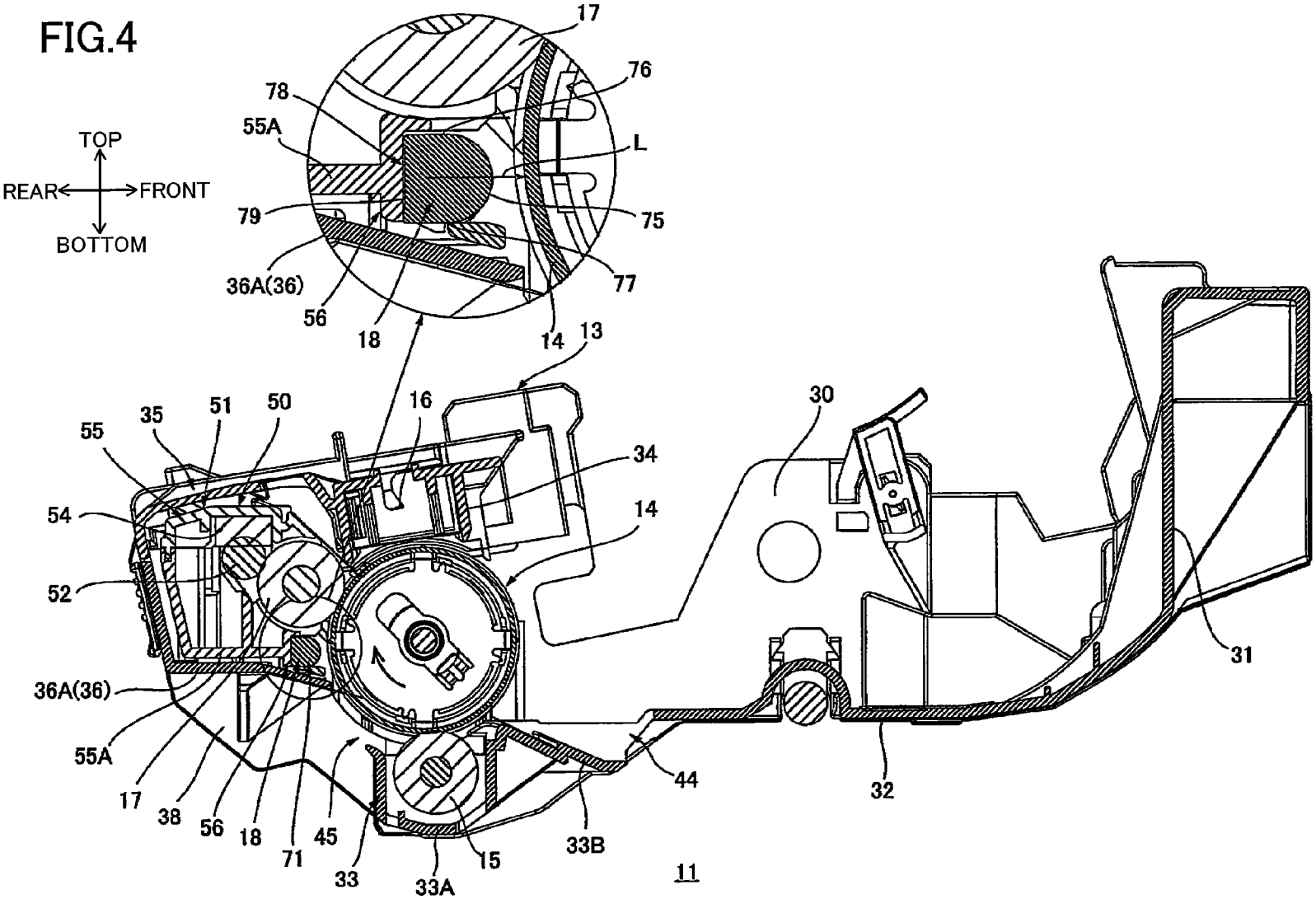
FIG. 4 is a center cross-sectional view of the drum cartridge shown in FIG. 3.

As shown in FIG. 2, the drum frame 13 has a frame-like structure with a closed bottom and is generally rectangular in a plan view. As shown in FIGS. 3 and 4, the drum frame 13 includes a pair of left and right side frame walls 30, a front frame wall 31, a bottom frame wall 32, a charger accommodating section 34, a cleaner accommodating section 35, a pair of ribs 38 (as an example of a pair of wall parts, a first wall and a second wall), a transfer-roller accommodating section 33, and a pair of coupling units 40.

As shown in FIG. 2, the side frame walls 30 constitute the left and right sides of the drum frame 13 and are aligned with but spaced apart from each other in the left-right direction. The side frame walls 30 have a plate shape that is generally rectangular in a side view and elongated in a front-rear direction.

The front frame wall 31 constitutes the front side of the drum frame 13 and bridges the front edges of the side frame walls 30. As shown in FIG. 4, the bottom frame wall 32 constitutes the bottom side of the drum frame 13 and bridges the bottom edges of the side frame walls 30 in the front portions thereof. The front edge of the bottom frame wall 32 is connected to the bottom edge of the front frame wall 31.

The charger accommodating section 34 is disposed on the rear side of the front frame wall 31 with a gap formed therebetween and on the upper rear side of the bottom frame wall 32 with a gap formed therebetween. Further, the charger accommodating section 34 is disposed above the transfer-roller accommodating section 33 with a gap formed therebetween. The charger accommodating section 34 has a general U-shape in a side view with the opening of the "U" facing downward and is elongated in the left-right direction. The left and right ends of the charger accommodating section 34 are respectively connected to the rear portions of the left and right side frame walls 30 in the top ends thereof.

The cleaner accommodating section 35 is disposed on the rear end portion of the drum frame 13 adjacent to the charger accommodating section 34 on the lower rear side thereof. The cleaner accommodating section 35 has a general U-shape in a side view with the opening of the "U" facing forward, and is elongated in the left-right direction. The left and right ends of the cleaner accommodating section 35 are respectively connected to the left and right side frame walls 30 in the rear ends thereof.

As shown in FIGS. 3 and 4, the cleaner accommodating section 35 has an accommodating-section bottom wall 36. The accommodating-section bottom wall 36 has a general plate shape that is elongated in the left-right direction and constitutes the bottom of the cleaner accommodating section 35. More specifically, the accommodating-section bottom wall 36 is integrally provided with a flat portion 36A, and a sloped portion 36B.

As shown in FIG. 4, the flat portion 36A extends in the front-rear direction and constitutes the portion of the accommodating-section bottom wall 36 other than the right end portion.

Figure 8:
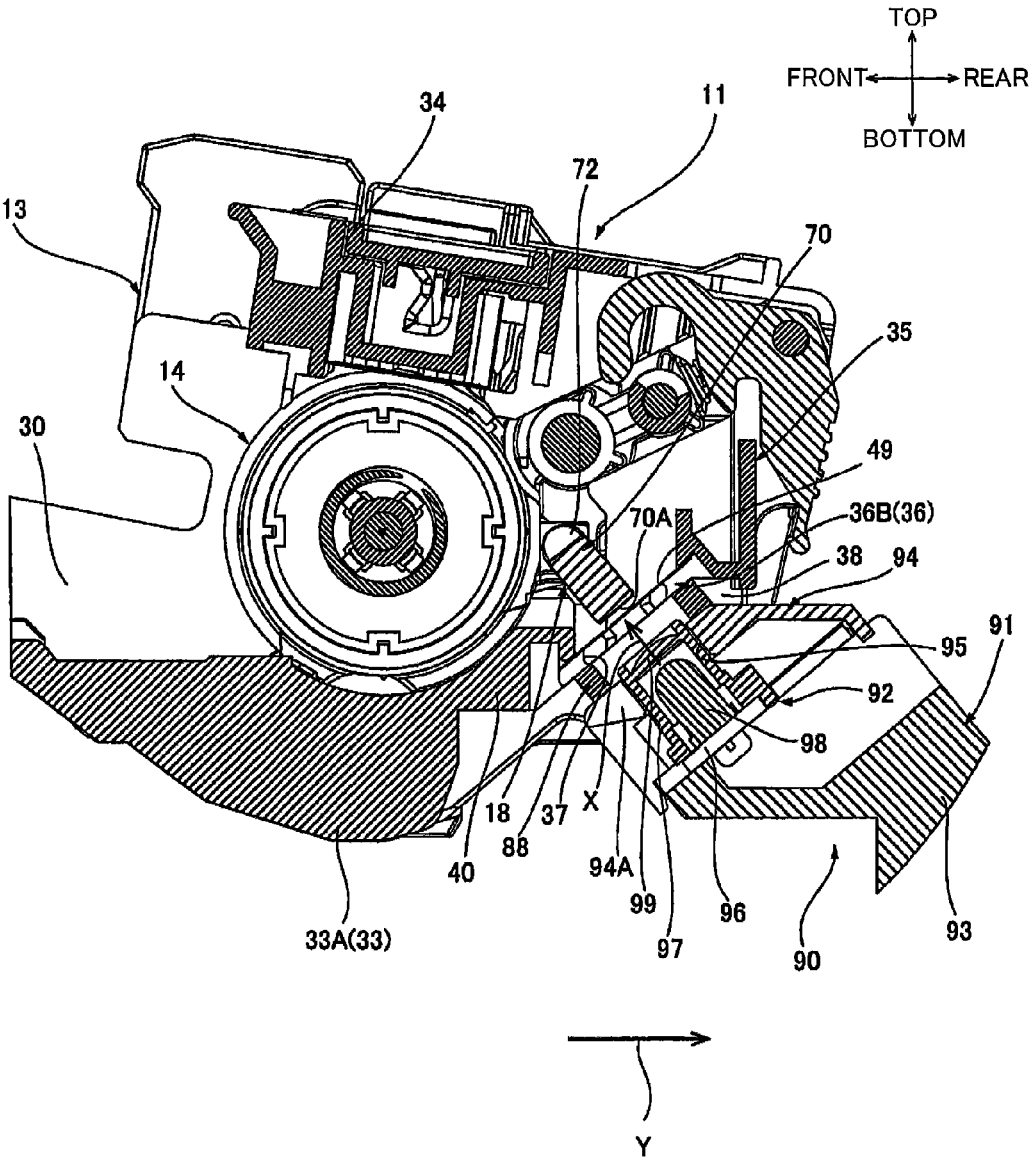
FIG. 8 is a cross-sectional view of the drum cartridge and the light source in FIG. 7B taken along a line A-A in FIG. 3.

The sloped portion 36B constitutes the right end portion of the accommodating-section bottom wall 36 as illustrated in FIG. 3 and extends in a direction sloping from the lower front toward the upper rear as illustrated in FIG. 8.

An opening 37 is formed in the sloped portion 36B.

As shown in FIGS. 3 and 8, the opening 37 is formed in the approximate center region of the sloped portion 36B. The opening 37 has a general rectangular shape when viewed from the lower rear side and penetrates the sloped portion 36B in a direction sloping from the upper front toward the lower rear.

As shown in FIG. 3, the pair of ribs 38 are provided on the lower rear portion of the drum frame 13 at the right end of the same. Specifically, as shown in FIG. 8, the ribs 38 are provided on the downstream portion of the drum cartridge 11 with respect to a mounting direction Y of the drum cartridge 11 relative to the main casing 2, as will be described later in greater detail.

As shown in FIG. 3, the ribs 38 are arranged spaced apart from each other in the left-right direction, with one on either side of the opening 37. As illustrated in FIG. 7B, the ribs 38 have a plate shape that is generally rectangular in a side view. The right rib 38 is integrally formed with the right side frame wall 30, protruding continuously in a direction downward and rearward from the lower rear edge of the right side frame wall 30. The left rib 38 is positioned leftward of and spaced apart from the right rib 38. The left rib 38 is integrally formed with the sloped portion 36B and protrudes in a direction diagonally downward and rearward from the bottom surface of the sloped portion 36B on the left side thereof.

As shown in FIG. 4, the transfer-roller accommodating section 33 is disposed obliquely downward and forward from the cleaner accommodating section 35 with a gap formed therebetween and is disposed rearward of the bottom frame wall 32 with a gap formed therebetween. The transfer-roller accommodating section 33 is elongated in the left-right direction. The left and right ends of the transfer-roller accommodating section 33 are connected to the rear portions of the corresponding left and right side frame walls 30 in the lower rear ends thereof. Each transfer-roller accommodating section 33 has an accommodating-section body 33A, and a lip portion 33B.

The accommodating-section body 33A has a general U-shape in a side view with the opening of the "U" facing upward and is elongated in the left-right direction.

The lip portion 33B is formed continuously with the top edge on the front wall of the accommodating-section body 33A and slopes diagonally downward and forward therefrom. The front edge of the lip portion 33B is positioned obliquely downward and rearward from the rear edge of the bottom frame wall 32. The space formed between the front edge of the lip portion 33B and the rear edge of the bottom frame wall 32 is defined as the supply opening 44. The supply opening 44 is formed in a size and shape that can allow passage of the sheets P.

Figure 7A:
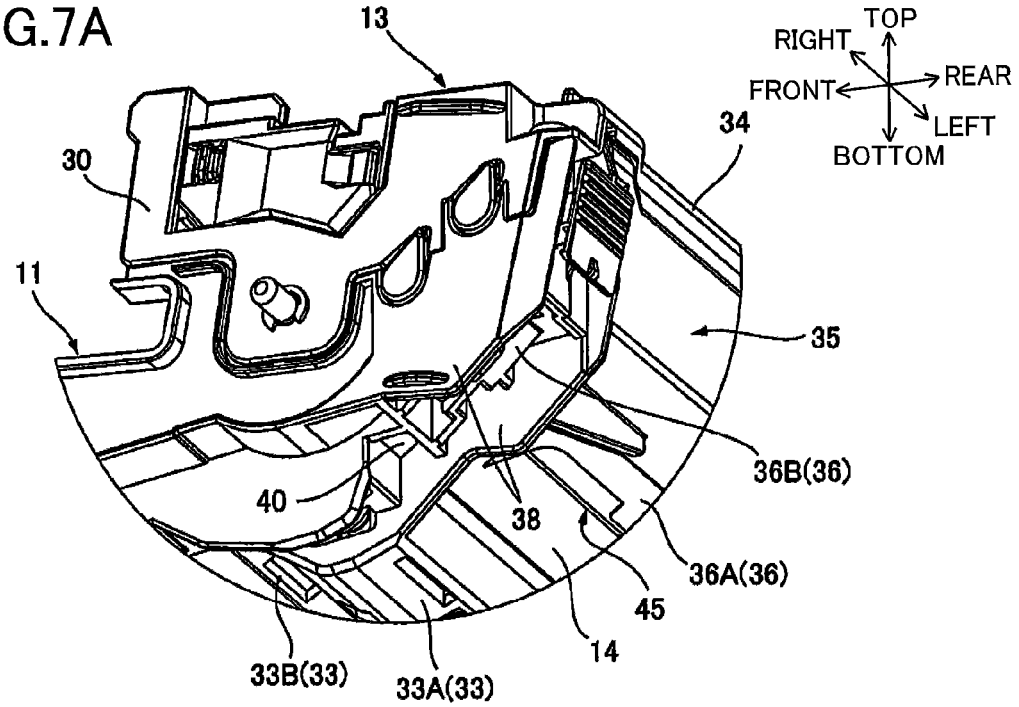
FIG. 7A is a perspective view of the drum cartridge shown in FIG. 4 as viewed from a lower right side thereof.
Figure 7B:
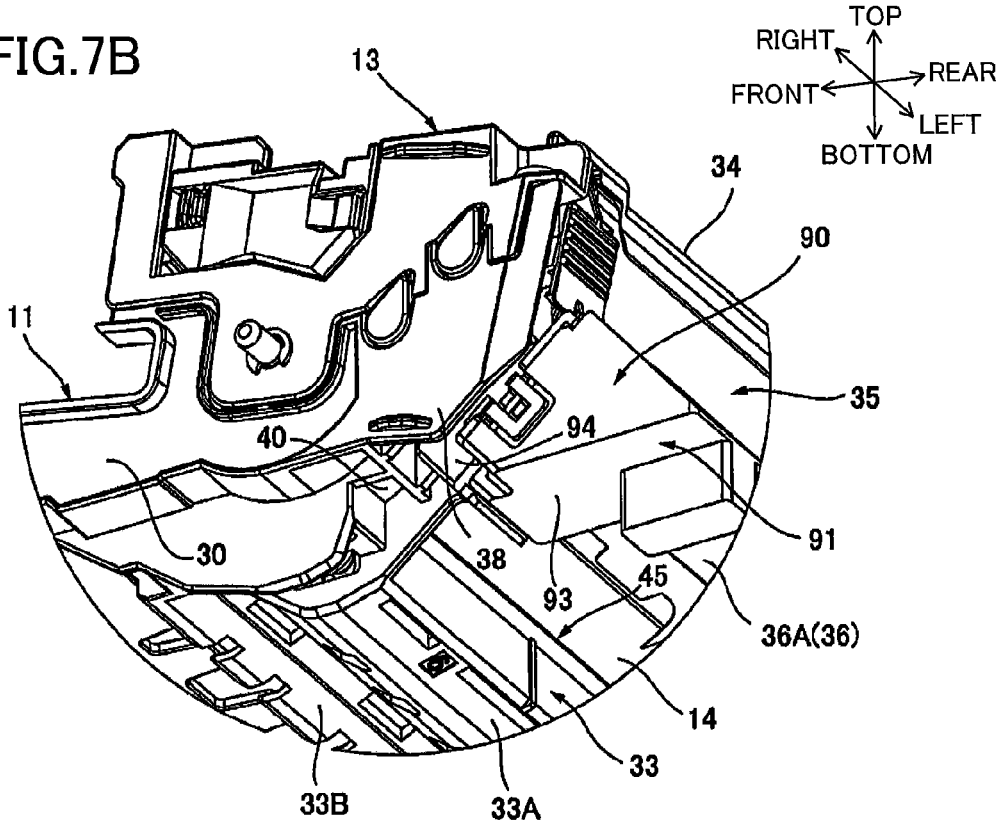
FIG. 7B is a perspective view of the drum cartridge shown in FIG. 7A and the light source shown in FIG. 6 as viewed from a lower right side thereof.

As shown in FIGS. 3, 7A, and 8, the pair of coupling units 40 are disposed at positions spaced apart from each other in the left-right direction and are respectively coupled with the left and right ends of the transfer-roller accommodating section 33 and the left and right ends of the accommodating-section bottom wall 36. More specifically, the left coupling unit 40 is coupled to the left end of the accommodating-section body 33A at the rear edge thereof and to the left end of the flat portion 36A at the front edge thereof, as shown in FIG. 3. The right coupling unit 40 is coupled to the right end of the accommodating-section body 33A at the rear edge thereof and to the front end of the sloped portion 36B, as shown in FIG. 8.

The space formed between the left-right inner edges of the respective coupling units 40, the rear edge of the accommodating-section body 33A, and the front edge of the flat portion 36A is defined as the discharge opening 45. Thus, the ribs 38 are disposed on the outer side of the discharge opening 45 in the left-right direction. The discharge opening 45 has a size and shape that can allow passage of the sheets P.

(2) Photosensitive Drum, Transfer Roller, and Scorotron Charger

As shown in FIG. 4, the drum frame 13 supports the photosensitive drum 14, the transfer roller 15, the scorotron charger 16, and the cleaning unit 50 between the pair of side frame walls 30.

The photosensitive drum 14 is disposed between the transfer-roller accommodating section 33 and the charger accommodating section 34 and forward of the cleaner accommodating section 35. The photosensitive drum 14 includes a metal tube having a general cylindrical shape that is arranged with its axis oriented in the left-right direction, and a photosensitive layer coating the circumferential surface of the metal tube.

The transfer roller 15 is accommodated in the accommodating-section body 33A. The transfer roller 15 is supported in the drum frame 13 with its left and right ends rotatably supported in the corresponding left and right side frame walls 30.

The scorotron charger 16 is accommodated in and supported in the charger accommodating section 34.

(3) Cleaning Unit

The cleaning unit 50 is positioned rearward of the photosensitive drum 14 and is accommodated in the cleaner accommodating section 35.

The cleaning unit 50 includes a cleaning frame 51, a cleaning roller 17, a collecting roller 52, and a sponge scraper 54.

The cleaning frame 51 is formed of a resin that is opaque and has a color capable of reflecting light. Specifically, the cleaning frame 51 is formed of white resin. The cleaning frame 51 is integrally configured of a frame body 55, and a light-guide support part 56.

The frame body 55 has a box-like shape that opens toward the front and includes a bottom wall 55A.

The light-guide support part 56 is disposed adjacent to the bottom wall 55A of the frame body 55 on its front edge. In a side view, the light-guide support part 56 has a general U-shape that opens toward the photosensitive drum 14. The front edge of the bottom wall 55A constituting the frame body 55 is connected to the rear wall of the light-guide support part 56 in the approximate vertical center region thereof. While not shown in the drawing, the left end of the light-guide support part 56 is closed while the right end of the light-guide support part 56 is open.

The cleaning roller 17 functions to remove deposited matter from the circumferential surface of the photosensitive drum 14. The cleaning roller 17 is disposed above the light-guide support part 56, with its rear portion projecting into the frame body 55 and its front portion exposed on the outside of the frame body 55. In this position, the cleaning roller 17 is disposed on the rear side of the photosensitive drum 14.

The cleaning roller 17 has a general columnar shape with its axis extending in the left-right direction. The cleaning roller 17 is supported in the cleaning frame 51 with its left and right ends rotatably supported in the corresponding left and right side walls of the frame body 55. The lower front surface of the cleaning roller 17 is in contact with the upper rear surface of the photosensitive drum 14.

The collecting roller 52 is disposed inside the frame body 55 on the upper rear side of the cleaning roller 17. The collecting roller 52 has a general columnar shape with its axis extending in the left-right direction. The collecting roller 52 is supported in the cleaning frame 51 with its left and right ends rotatably supported in the corresponding left and right side walls of the frame body 55. The lower front surface of the collecting roller 52 is in contact with the upper rear surface of the cleaning roller 17.

The sponge scraper 54 is disposed inside the frame body 55 and is wedged between the top wall of the frame body 55 and the collecting roller 52. The sponge scraper 54 is fixed to the bottom surface on the top wall of the frame body 55. The bottom surface of the sponge scraper 54 contacts the upper surface of the collecting roller 52.

During the image-forming operation described above, the cleaning unit 50 having this configuration removes and collects paper dust and other matter deposited on the photosensitive drum 14 after a static-eliminating operation described later has been performed. The cleaning operation of the cleaning unit 50 will be described next.

When the cleaning unit 50 performs a cleaning operation, an apparatus-side electrode (not shown) provided in the main casing 2 applies bias to the cleaning roller 17, charging the cleaning roller 17 with a higher positive polarity than the surface potential of the photosensitive drum 14. Another apparatus-side electrode (not shown) also applies a bias to the collecting roller 52 so that the collecting roller 52 is charged with a higher positive polarity than the cleaning roller 17.

The cleaning roller 17 collects any deposited paper dust from the surface of the photosensitive drum 14. The paper dust collected on the cleaning roller 17 is subsequently attracted to the collecting roller 52. Next, the sponge scraper 54 scrapes the paper dust off the collecting roller 52, and the paper dust is collected in the frame body 55.

(4) Light Guide

The light guide 18 functions to guide light emitted from a light source 90 (described later) toward the surface of the photosensitive drum 14 in order to neutralize charge (to eliminate static) on the photosensitive drum 14. The light guide 18 is supported in the light-guide support part 56 of the cleaning frame 51. Thus, the light guide 18 is supported in the cleaner accommodating section 35 through the cleaning frame 51.

Figure 5A:
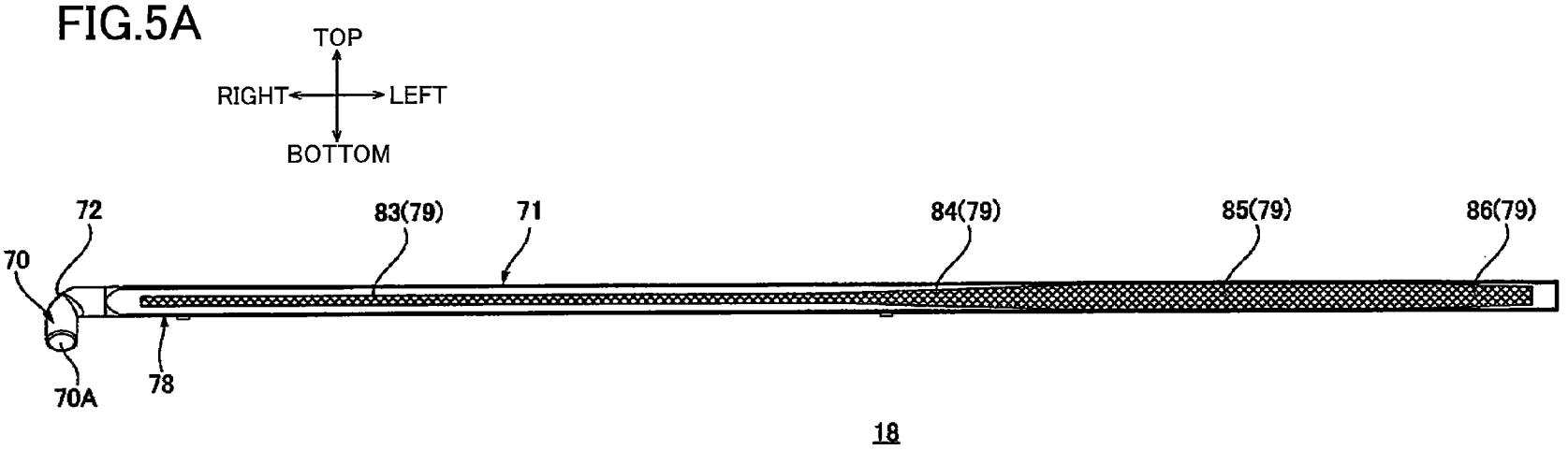
FIG. 5A is a rear view of a light guide provided in the drum cartridge shown in FIG. 4.
Figure 5B:
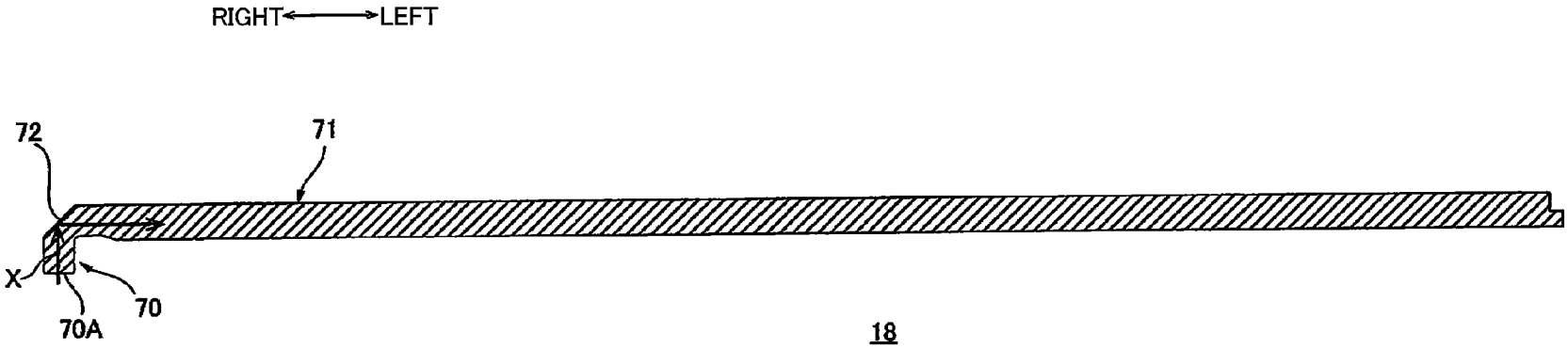
FIG. 5B is a cross-sectional view of the light guide shown in FIG. 5A.

The light guide 18 is formed of a transparent and colorless acrylic resin, for example. As shown in FIG. 5B, the light guide 18 is configured of a rod-like member formed in a general L-shape. The light guide 18 has a first part 70 as an example of a light receiving part, a second part 71, and a light-path converting surface 72 as an example of a third part.

The first part 70 constitutes the right end of the light guide 18. As shown in FIG. 8, the first part 70 has a general columnar shape that extends along the direction sloping from the upper front toward the lower rear. The first part 70 also has an incident surface 70A.

The incident surface 70A constitutes the lower rear end-face of the first part 70. As shown in FIG. 5B, the incident surface 70A is a flat surface orthogonal to the extended direction of the first part 70 (i.e. the direction sloping from the upper front toward the lower rear).

The second part 71 has a general rod shape that extends in the left-right direction. The second part 71 has a left-right dimension greater than a left-right dimension of the light-guide support part 56, and has a vertical dimension approximately the same as an inner vertical dimension of the light-guide support part 56. The right end of the second part 71 is connected to the upper front end of the first part 70 on the opposite end of the incident surface 70A.

As shown in FIG. 4, the second part 71 has a general rectangular shape in a side view. Specifically, the second part 71 is configured of an arc surface 75, a top surface 76, a bottom surface 77, and a back surface 78.

The arc surface 75 constitutes the front surface of the second part 71. The arc surface 75 is a curved surface that has a general semicircular arc shape in a side view, the convex side of the arc protruding forward. The top surface 76 constitutes the top surface of the second part 71 and is a flat surface that extends continuously rearward from the top edge of the arc surface 75. The bottom surface 77 constitutes the bottom surface of the second part 71 and is a flat surface that extends continuously rearward from the bottom edge of the arc surface 75.

The back surface 78 constitutes the rear surface of the second part 71 and is a flat surface that extends vertically and connects the rear edges of the top surface 76 and bottom surface 77. As shown in FIG. 5A, the back surface 78 has a roughened surface part 79.

The roughened surface part 79 is provided in the approximate vertical center region of the back surface 78. The roughened surface part 79 is recessed forward from the back surface 78. This recessed portion is roughened to give it tiny irregularities (a pearskin finish) and may be formed through a surface texturing process (etching process), for example. Cross-hatching has been used in FIG. 5A to distinguish the roughened surface part 79 from the surrounding portion of the back surface 78.

The roughened surface part 79 extends in the left-right direction and has a left-right dimension approximately nine-tenths a left-right dimension of the back surface 78, for example. More specifically, the roughened surface part 79 includes a narrowest part 83, a gradually-widening part 84, a widest part 85, and a gradually-narrowing part 86.

The narrowest part 83 constitutes the right portion of the roughened surface part 79 and extends leftward from the right edge of the roughened surface part 79 to the approximate left-right center of the roughened surface part 79. Thus, a left-right dimension of the narrowest part 83 is approximately one-half the left-right dimension of the roughened surface part 79. A vertical dimension of the narrowest part 83 is approximately one-third a vertical dimension of the back surface 78, for example. The vertical dimension of the narrowest part 83 is uniform across its entire left-right dimension. The right edge of the narrowest part 83, i.e., the right edge of the roughened surface part 79, is disposed leftward and spaced apart from the right end of the second part 71.

The gradually-widening part 84 is disposed leftward of and in proximity to the narrowest part 83. The gradually-widening part 84 extends continuously leftward from the left edge of the narrowest part 83. A vertical dimension of the gradually-widening part 84 grows gradually larger toward the left. A left-right dimension of the gradually-widening part 84 is approximately one-seventh the left-right dimension of the roughened surface part 79.

The widest part 85 is disposed leftward of and in proximity to the gradually-widening part 84. The widest part 85 extends continuously leftward from the left edge of the gradually-widening part 84. A left-right dimension of the widest part 85 is approximately one-fourth the left-right dimension of the roughened surface part 79. A vertical dimension of the widest part 85 is approximately nine-tenths the vertical dimension of the back surface 78, for example, and remains uniform across its entire left-right dimension.

The gradually-narrowing part 86 constitutes the left end portion of the roughened surface part 79 and disposed leftward of and in proximity to the widest part 85. The gradually-narrowing part 86 extends continuously leftward from the left edge of the widest part 85. A vertical dimension of the gradually-narrowing part 86 grows gradually smaller toward the left. A left-right dimension of the gradually-narrowing part 86 is approximately one-tenth the left-right dimension of the roughened surface part 79. The left edge of the gradually-narrowing part 86, i.e., the left edge of the roughened surface part 79 is disposed rightward and spaced apart from the left endface of the second part 71.

As shown in FIG. 5B, the light-path converting surface 72 is disposed in the region at which the first part 70 connects to the second part 71. The light-path converting surface 72 is formed by cutting the right end of the connecting portion between the first part 70 and the second part 71 at an approximate 45-degree slope to the left-right direction. Hence, the light-path converting surface 72 is a sloped surface that is angled approximately 45 degrees with respect to the left-right direction.

The light-path converting surface 72 is aligned with the first part 70 when viewed from the upper front toward the lower rear and is aligned with the second part 71 when viewed in the left-right direction.

As shown in FIG. 4, the light guide 18 is supported in the cleaning frame 51 at a position beneath the cleaning roller 17 by accommodating the second part 71 in the light-guide support part 56.

With this configuration, the second part 71 faces the photosensitive drum 14 on the rear side of the photosensitive drum 14 but spaced apart therefrom. The arc surface 75 of the second part 71 protrudes toward the photosensitive drum 14.

As shown in FIG. 8, the first part 70 and the light-path converting surface 72 are positioned farther rightward than the right end of the light-guide support part 56. The first part 70 and the light-path converting surface 72 are disposed in the cleaner accommodating section 35 at a position spaced apart from the sloped portion 36B of the accommodating-section bottom wall 36 on the upper front side thereof. The incident surface 70A of the first part 70 faces the opening 37 in the sloped portion 36B in the direction sloping from the upper front toward the lower rear. Hence, the incident surface 70A is positioned between the pair of ribs 38 when viewed from the lower rear.

(5) Film Member

The film member 49 is disposed on the top surface of the sloped portion 36B. The film member 49 is configured of a transparent resin film, for example, that is light transmissive. The film member 49 is disposed across the opening 37 to cover the opening 37 and is fixed to the sloped portion 36B.

<Detailed Structure of Main Casing>

Figure 6:
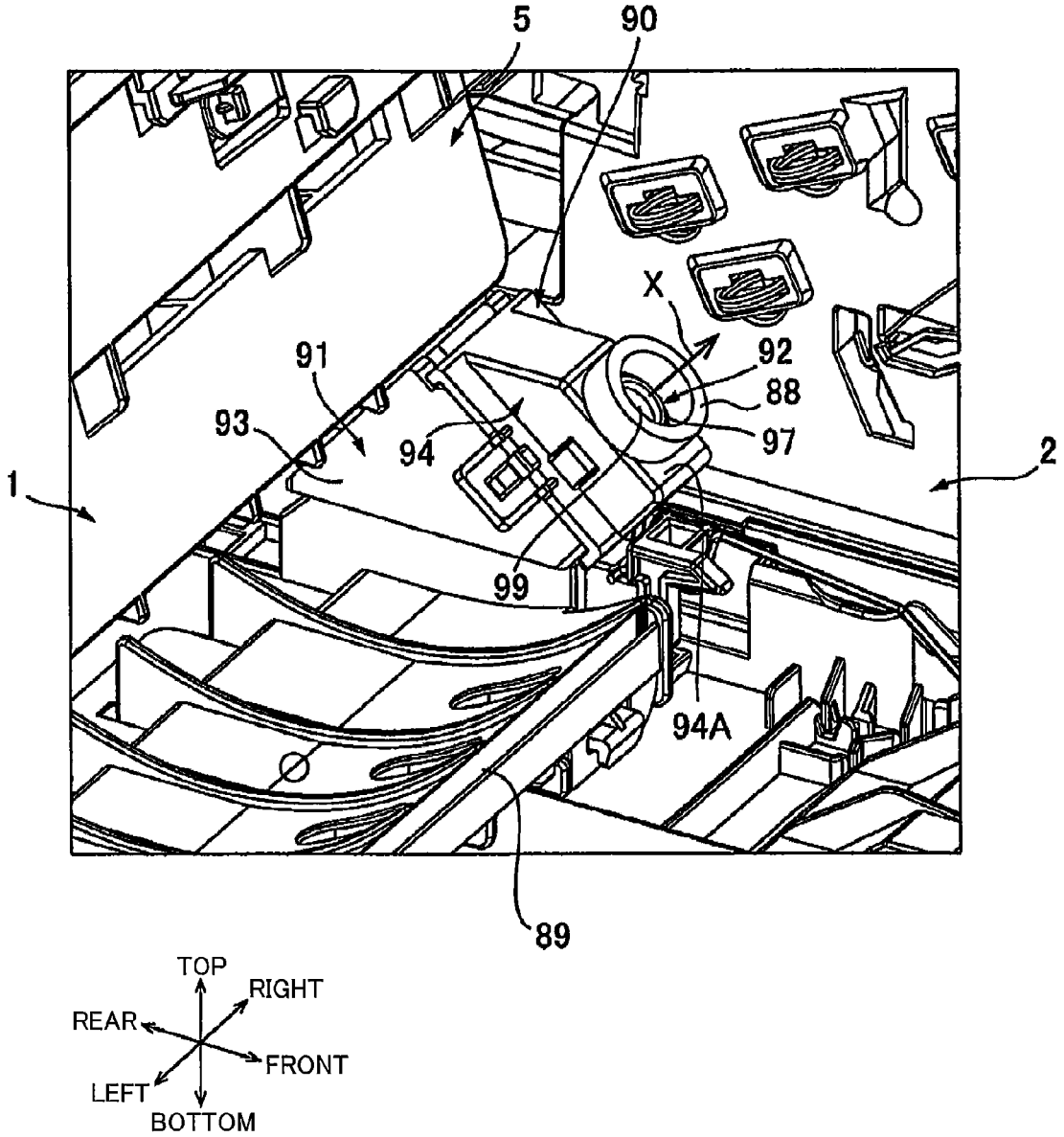
FIG. 6 is a perspective view of a light source provided in the printer shown in FIG. 1 as viewed from an upper left side thereof.

As shown in FIGS. 1 and 6, the main casing 2 includes the conveyance guide 89, and the light source 90.

The conveyance guide 89 is disposed on the inside of the main casing 2 in front of the pressure roller 27. The conveyance guide 89 has a plate shape that is elongated in the left-right direction and is curved such that the approximate front-rear center portion protrudes downward.

As shown in FIG. 6, the light source 90 is disposed inside the main casing 2 to the right of the conveyance guide 89. The light source 90 is provided with a support frame 91 as an example of a support part, a light emitting unit 92 as an example of an emitting part, and a cover member 88.

The support frame 91 includes a seat part 93, and an insertion part 94.

The seat part 93 constitutes the lower rear portion of the support frame 91. The seat part 93 has a general triangular columnar shape and is elongated in the left-right direction. Specifically, the bottom surface of the seat part 93 extends in the front-rear direction; the upper front surface of the seat part 93 bends and extends diagonally upward and rearward from the front edge on the bottom surface of the seat part 93; and the upper rear surface of the seat part 93 bends and extends diagonally downward and rearward from the top edge on the upper front surface of the seat part 93 and connects to the rear edge on the bottom surface of the seat part 93.

A left-right dimension of the seat part 93 is greater than the distance in the left-right direction between the pair of ribs 38.

The insertion part 94 constitutes the upper front portion of the support frame 91 and is disposed on the upper front surface of the seat part 93. The insertion part 94 has a box-like shape that is open on the lower rear side. In a side view, the insertion part 94 has a general rectangular shape that extends in the direction sloping from the lower front toward the upper rear. A left-right dimension of the insertion part 94 is smaller than the left-right dimension of the seat part 93.

The insertion part 94 has a support wall 94A. The support wall 94A constitutes the upper front side of the insertion part 94 and has a general plate shape that extends in the direction sloping from the lower front toward the upper rear. An insertion hole 95 (see also FIG. 8) is formed in the support wall 94A.

As shown in FIG. 8, the insertion hole 95 has a general circular shape when viewed from the upper front side and penetrates the support wall 94A in the direction sloping from the upper front toward the lower rear.

The light emitting unit 92 is accommodated in the insertion part 94. The light emitting unit 92 includes a substrate part 96, a cylindrical part 97, a light emitting part 98, and a lens part 99.

The substrate part 96 has a general plate shape that is elongated in the direction sloping from the lower front toward the upper rear. The substrate part 96 is electrically connected to an apparatus-side substrate (not shown). The cylindrical part 97 has a general cylindrical shape that is elongated in the direction sloping from the upper front toward the lower rear. The cylindrical part 97 is disposed on the upper front surface of the substrate part 96.

The light emitting part 98 is fixed to the substrate part 96 on the inside of the cylindrical part 97. The light emitting part 98 is configured of an LED light provided with an LED, for example. The light emitting part 98 is electrically connected to the substrate part 96 and is configured to emit light along an emission direction X. The emission direction X is a direction angled from the lower rear toward the upper front. Hence, the light emitting part 98 is configured to emit light in a direction that crosses the left-right direction.

The lens part 99 is disposed inside the cylindrical part 97 on the upper front side of the light emitting part 98. The lens part 99 is supported in the inner circumferential surface of the cylindrical part 97 at the upper front end thereof. The lens part 99 is a convex lens that protrudes diagonally upward and forward, for example.

The light emitting unit 92 is accommodated in the insertion part 94 such that the upper front end of the cylindrical part 97 is inserted in the insertion hole 95. Thus, the light emitting unit 92 is supported in the support frame 91. Further, the insertion part 94 and the light emitting unit 92 are disposed upstream of the seat part 93 in the mounting direction Y (described later). Note that the upper front end of the cylindrical part 97 protrudes slightly downstream of the support wall 94A in the emission direction X, as illustrated in FIGS. 6 and 8.

The cover member 88 is disposed on the upper front surface of the support wall 94A. The cover member 88 is configured of an elastic member such as a sponge and is provided as a separate member from the main casing 2 and the drum cartridge 11. The cover member 88 has a general cylindrical shape and extends in the direction sloping from the upper front toward the lower rear. An inner diameter of the cover member 88 is greater than an outer diameter of the cylindrical part 97.

The cover member 88 is positioned to surround the cylindrical part 97 when viewed from the downstream side of the emission direction X. A gap is formed between the inner circumferential surface of the cover member 88 and the outer circumferential surface of the cylindrical part 97 at the upper front end thereof in a radial direction of the cover member 88. Further, the cover member 88 protrudes further downstream in the emission direction X than the upper front end of the cylindrical part 97.

The cover member 88 is adhesively fixed to the support wall 94A using a publicly known double-sided tape or the like. Hence, the cover member 88 is supported on the light source 90.

<Mounting and Removing Operations of Drum Cartridge Relative to Main Casing>

Next, the operations for mounting the drum cartridge 11 in the main casing 2 and removing the drum cartridge 11 from the main casing 2 will be described.

To mount the drum cartridge 11 in the main casing 2, first the user mounts the developing cartridge 12 in the drum cartridge 11 to configure the process cartridge 3, as shown in FIG. 1.

Next, the user inserts the process cartridge 3 into the main casing 2 through the access opening 6. The process cartridge 3 is inserted into the main casing 2 along the mounting direction Y, i.e., in a rearward direction.

At this time, the insertion part 94 of the light source 90 is received between the pair of ribs 38, as illustrated in FIGS. 7A and 7B.

Thus, the sloped portion 36B of the accommodating-section bottom wall 36 confronts but remains spaced apart from the support wall 94A of the insertion part 94 in the emission direction X, and the opening 37 in the sloped portion 36B is aligned with the lens part 99 of the light emitting unit 92 in the emission direction X.

Consequently, the incident surface 70A of the first part 70 is aligned with the light emitting part 98 in the emission direction X but spaced apart downstream from the light emitting part 98 in the emission direction X, with the opening 37 and the lens part 99 interposed therebetween. Hence, the opening 37 is positioned between the first part 70 and the light emitting part 98.

At this time, the cover member 88 is sandwiched between the sloped portion 36B and the support wall 94A and is elastically deformed therebetween. Hence, the cover member 88 contacts both the sloped portion 36B and the support wall 94A, sealing the gap between the sloped portion 36B and the support wall 94A.

The above steps complete the operation for mounting the process cartridge 3 in the main casing 2. Hence, the above steps complete the operation for mounting the drum cartridge 11 in the main casing 2.

While the drum cartridge 11 is mounted in the main casing 2, the light source 90 is positioned on the lower rear side of the sloped portion 36B and ribs 38 provided in the drum cartridge 11. That is, the light source 90 is positioned aligned with and downstream of the sloped portion 36B and ribs 38 in the mounting direction Y.

Further, the insertion part 94 of the light source 90, i.e., the upstream end of the light source 90 with respect to the mounting direction Y is positioned between the ribs 38 in the left-right direction, as shown in FIG. 8. Accordingly, the lens part 99 of the light emitting unit 92 accommodated in the insertion part 94 is disposed between the ribs 38 in the left-right direction.

Further, the accommodating-section body 33A of the drum frame 13 is positioned on the front side of the conveyance guide 89, whereby the discharge opening 45 is positioned on the upper front side of the conveyance guide 89.

When removing the drum cartridge 11 from the main casing 2, the above steps for mounting the drum cartridge 11 in the main casing 2 are performed in reverse. Specifically, the user pulls the process cartridge 3 forward through the access opening 6. The drum cartridge 11 passes through the access opening 6 as part of the process cartridge 3 and is removed from the main casing 2. This completes the operation for removing the drum cartridge 11 from the main casing 2.

<Static-Eliminating Operation>

Sometimes electrical charge remains on the circumferential surface of the photosensitive drum 14 after a toner image is transferred from the photosensitive drum 14 to a sheet P during the image-forming operation described above. Therefore, a static-eliminating operation is performed to remove residual charge from the circumferential surface of the photosensitive drum 14.

In the static-eliminating operation for the photosensitive drum 14, a substrate (not shown) supplies power to the light source 90, and the light emitting part 98 of the light source 90 emits light in the emission direction X for neutralizing charge on the photosensitive drum 14, as shown in FIG. 8. The light emitted from the light emitting part 98 passes through the lens part 99, the opening 37 formed in the sloped portion 36B, and the film member 49 and enters the first part 70 through the incident surface 70A. In other words, the first part 70 receives light from the light source 90.

Light entering the first part 70 advances diagonally upward and forward in the first part 70 along the emission direction X until arriving at the light-path converting surface 72, as shown in FIG. 5B.

The light-path converting surface 72 reflects light passing through the first part 70 at an angle of approximately 90 degrees, changing the direction in which the light advances from the direction angled upward and forward to the leftward direction. In this way, light passing through the first part 70 is guided toward the second part 71. The light guided to the second part 71 advances through the second part 71 in the leftward direction.

As the light passes through the second part 71, the roughened surface part 79 of the back surface 78 reflects the light forward toward the arc surface 75, as shown in FIG. 4. Hence, light reflected by the roughened surface part 79 advances forward (as indicated by an arrow L in FIG. 4) and passes through the arc surface 75 to be irradiated on the circumferential surface of the photosensitive drum 14.

Light irradiated on the photosensitive drum 14 in this way removes any residual charge from the circumferential surface of the photosensitive drum 14.

<Operational Advantages>

(1) As shown in FIG. 8, the light source 90 is positioned between the pair of ribs 38 when the drum cartridge 11 is mounted in the main casing 2. Accordingly, the ribs 38 provide covering around the left and right sides of the light source 90.

Thus, when toner particles, paper dust, or other matter scatters inside the main casing 2, the ribs 38 can block such matter traveling toward the light source 90 from the outer left and right sides thereof, reducing contamination of the light source 90.

Further, by covering the light source 90 from the outer left and right sides thereof, the ribs 38 prevent light emitted from the light source 90 from traveling outward in the left and right directions, thereby guiding the light emitted from the light source 90 more reliably toward the light guide 18.

(2) As shown in FIG. 8, the light source 90 is disposed downstream of the sloped portion 36B of the drum cartridge 11 in the mounting direction Y, and the ribs 38 are disposed on the downstream portion of the drum frame 13 constituting the drum cartridge 11 in the mounting direction Y. Accordingly, when the drum cartridge 11 is mounted in the main casing 2, the insertion part 94 of the light source 90 can be reliably positioned between the ribs 38, thereby reliably reducing contamination of the light source 90.

(3) As shown in FIGS. 3 and 8, the first part 70 is positioned between the pair of ribs 38 when viewed from the lower rear side thereof. Hence, when the drum cartridge 11 is mounted in the main casing 2 and the light source 90 is positioned between the ribs 38, this configuration improves the precision in positioning the first part 70 and the light source 90 relative to each other. Thus, the first part 70 of the light guide 18 can reliably receive light emitted from the light source 90.

(4) As shown in FIG. 8, the lens part 99 of the light emitting unit 92 that emits light is disposed between the pair of ribs 38. This arrangement can reliably reduce contamination of the lens part 99 while suppressing light emitted from the light emitting unit 92 from traveling outward in the left and right directions so that the light emitted from the light emitting unit 92 is reliably guided to the light guide 18.

(5) As shown in FIG. 7A, the ribs 38 are integrally provided on the drum frame 13, thereby reducing the number of required parts.

(6) As shown in FIG. 8, the film member 49 is disposed between the first part 70 of the light guide 18 and the light emitting part 98 of the light source 90 and is arranged across the opening 37 through which light emitted from the light source 90 passes. Accordingly, the film member 49 suppresses toner particles, paper dust, and the like that drops off the drum frame 13 from passing through the opening 37 toward the light source 90.

On the other hand, since the film member 49 transmits light, light emitted from the light source 90 can travel through the opening 37 and the film member 49 to reach the light guide 18.

Hence, this configuration more reliably reduces contamination of the light source 90 while enabling light emitted from the light source 90 to reach the light guide 18.

(7) As shown in FIG. 6, the cover member 88 is arranged to surround the lens part 99 of the light emitting unit 92 when viewed in the emission direction X of light emitted from the light emitting unit 92. Further, the cover member 88 contacts both the support frame 91 and the drum cartridge 11, as shown in FIG. 8, sealing the space between the support frame 91 and the drum cartridge 11.

Thus, the lens part 99 of the light emitting unit 92 that emits light is surrounded by the cover member 88, the support frame 91, and the drum cartridge 11. Accordingly, even when toner particles, paper dust, and the like scatter within the main casing 2, this construction suppresses such toner particles, paper dust and the like from coming into contact with the light source 90, reducing contamination of the light source 90, and hence the lens part 99.

Further, since the cover member 88 surrounds the light emitting unit 92, the cover member 88 can restrain light emitted from the light emitting unit 92 from leaking outside the cover member 88, thereby reliably guiding light from the light emitting unit 92 to the light guide 18.

(8) As shown in FIG. 8, the cover member 88 protrudes further downstream in the emission direction X than the cylindrical part 97 of the light emitting unit 92. Hence, when contacted by the support frame 91 and the drum cartridge 11, the cover member 88 can reliably surround the light emitting unit 92.

(9) As shown in FIG. 6, the cover member 88 is supported on the light source 90. This arrangement improves the precision of positioning the cover member 88 and the light emitting unit 92 relative to each other. Thus, the cover member 88 can be reliably positioned to surround the lens part 99 when viewed in the emission direction X.

(10) As shown in FIG. 8, the cover member 88 is configured of an elastic member that elastically deforms when contacted by the support frame 91 and the drum frame 13. Thus, the cover member 88 can more reliably close off the space between the support frame 91 and the drum cartridge 11.

(11) As shown in FIG. 8, the light source 90 is arranged juxtaposed to the drum cartridge 11 in the mounting direction Y when the drum cartridge 11 is mounted in the main casing 2. This arrangement allows the printer 1 to be made more compact in the left-right direction than an arrangement that places the light source 90 juxtaposed to the mounted drum cartridge 11 in the left-right direction.

(12) As shown in FIG. 8, the light emitting unit 92 emits light in the direction angled upward and forward. There is a case where scattered toner particles, paper dust, and the like in the main casing 2 fall by their own weight and become deposited on the lens part 99 of the light emitting unit 92. This deposition can obstruct the passage of light emitted from the light emitting unit 92.

However, in the structure described above, the cover member 88 is arranged to surround the lens part 99 of the light emitting unit 92 when viewed in the emission direction X in which light is emitted from the light emitting unit 92 and seals off the space between the support frame 91 and the drum frame 13. Accordingly, the cover member 88 can suppress toner particles, paper dust, and the like from becoming deposited on the lens part 99, even when the light emitting unit 92 is configured to emit light upward.

Variations of First Embodiment (1) In the first embodiment described above, the light source 90 supports the cover member 88, as shown in FIG. 6. However, a cover member 188 may be supported on the drum cartridge 11, as illustrated in FIG. 9A.

Figure 9A:
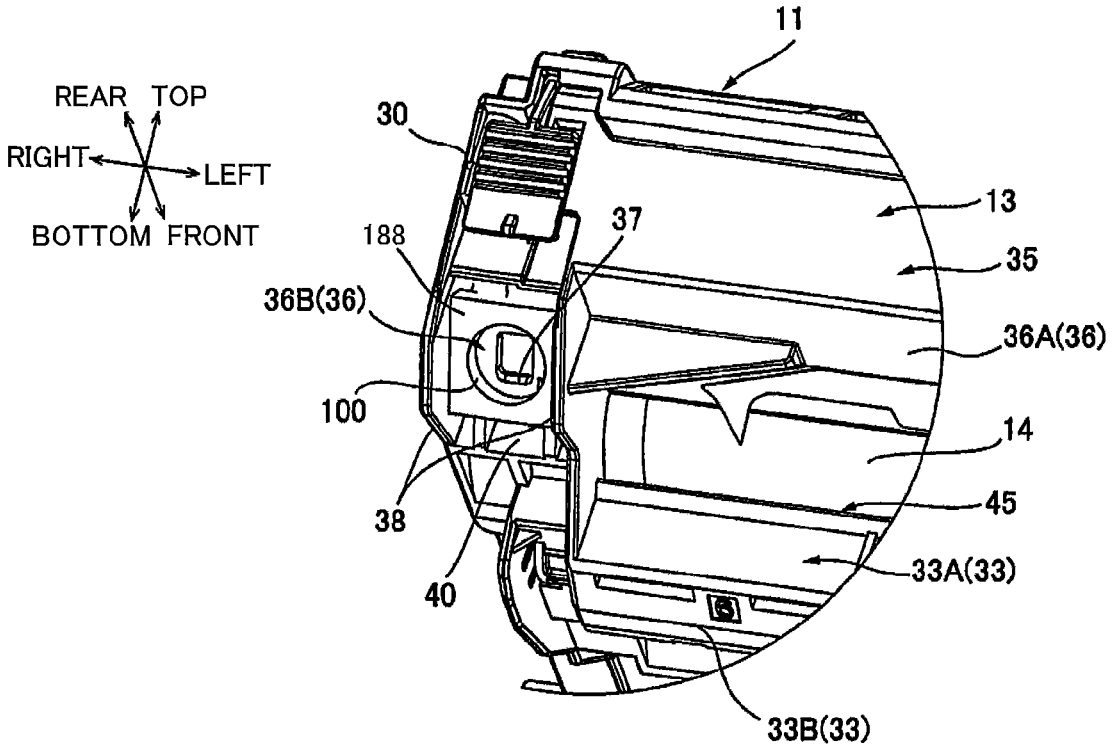
FIG. 9A is a perspective view of a drum cartridge according to a variation of the first embodiment as viewed from a lower rear side thereof.

In the example of FIG. 9A, the cover member 188 is supported on the sloped portion 36B of the accommodating-section bottom wall 36. Specifically, the cover member 188 is disposed on the bottom surface of the sloped portion 36B between the pair of ribs 38 and is adhesively fixed to the sloped portion 36B using a public known double-sided tape or the like.

In this example, the cover member 188 has a rectangular shape when viewed from the lower rear side. A through-hole 100 is formed in the approximate center region of the cover member 188. The through-hole 100 has a circular shape when viewed from the lower rear side and penetrates the cover member 188 in the direction sloping from the upper front toward the lower rear. Thus, the opening 37 is exposed in the through-hole 100 when viewed from the lower rear side.

In this variation, the cover member 188 is sandwiched between the sloped portion 36B and the support wall 94A when the drum cartridge 11 is mounted in the main casing 2, thereby sealing the gap between the sloped portion 36B and the support wall 94A. Accordingly, this construction can obtain the same operational advantages described above in the first embodiment.

Further, since the cover member 188 is supported on the drum cartridge 11, this arrangement improves the precision in positioning the cover member 188 relative to the drum cartridge 11. Hence, the cover member 188 can reliably seal the gap between the drum cartridge 11 and the support frame 91.

(2) In the first embodiment described above, the drum frame 13 is provided with the pair of ribs 38, as shown in FIG. 3, and the light source 90 is provided with the cover member 88, as shown in FIG. 6. However, the structure of the printer 1 is not limited to this configuration but may include any one of the pair of ribs 38 and the cover member 88.

Figure 9B:
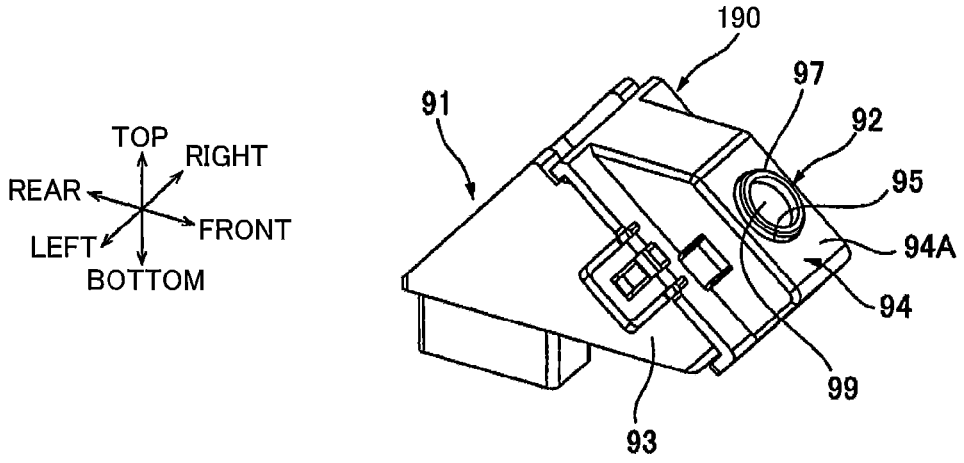
FIG. 9B is a perspective view of a light source according to another variation of the first embodiment as viewed from an upper front side thereof.

For example, the cover member 88 may be dispensed with, provided that the drum frame 13 includes the pair of ribs 38. As illustrated in FIG. 9B, a light source 190 does not include the cover member 88.

In this case, the insertion part 94 of the light source 190 is positioned between the pair of ribs 38 when the drum cartridge 11 is mounted in the main casing 2. This arrangement can still suppress toner particles, paper dust, and the like from traveling from the outer left and right sides of the insertion part 94 toward the light emitting unit 92 accommodated in the insertion part 94, thereby reducing contamination of the light emitting unit 92.

While not shown in the drawings, it is also possible to omit the pair of ribs 38 from the drum frame 13 while providing the cover member 88 on the light source 90.

(3) In the first embodiment described above, the cover member 88 contacts both the support wall 94A of the insertion part 94 and the sloped portion 36B of the accommodating-section bottom wall 36 when the drum cartridge 11 is mounted in the main casing 2, as shown in FIG. 8. However, there is no particular limitation on the cover member 88, provided that the cover member 88 can seal the space between the support frame 91 and the drum cartridge 11.

For example, the cover member 88 may be configured to contact the light guide 18 and the support wall 94A of the insertion part 94 when the drum cartridge 11 is mounted in the main casing 2.

In this case, the first part 70 of the light guide 18 is provided with a flange part that expands radially outward therefrom (not shown in the drawings). The cover member 88 is then interposed between and contacted by the flange part of the first part 70 and the support wall 94A of the insertion part 94 when the drum cartridge 11 is mounted in the main casing 2. This configuration can obtain the same operational advantages described above in the first embodiment.

2. Second Embodiment

Next, a second embodiment of the present invention will be described while referring to FIGS. 10 through 12C, wherein like parts and components are designated with the same reference numerals to avoid duplicating description.

In the second embodiment, a drum frame 213 of a drum cartridge 211 includes a pair of ribs 238, and a main casing 202 includes a light source 290. Further, in the second embodiment, the cover member 88 is dispensed with. In the following description, only parts differing from those of the first embodiment will be described in detail.

In the second embodiment, the left-right direction is an example of an orthogonal direction.

Figure 10:
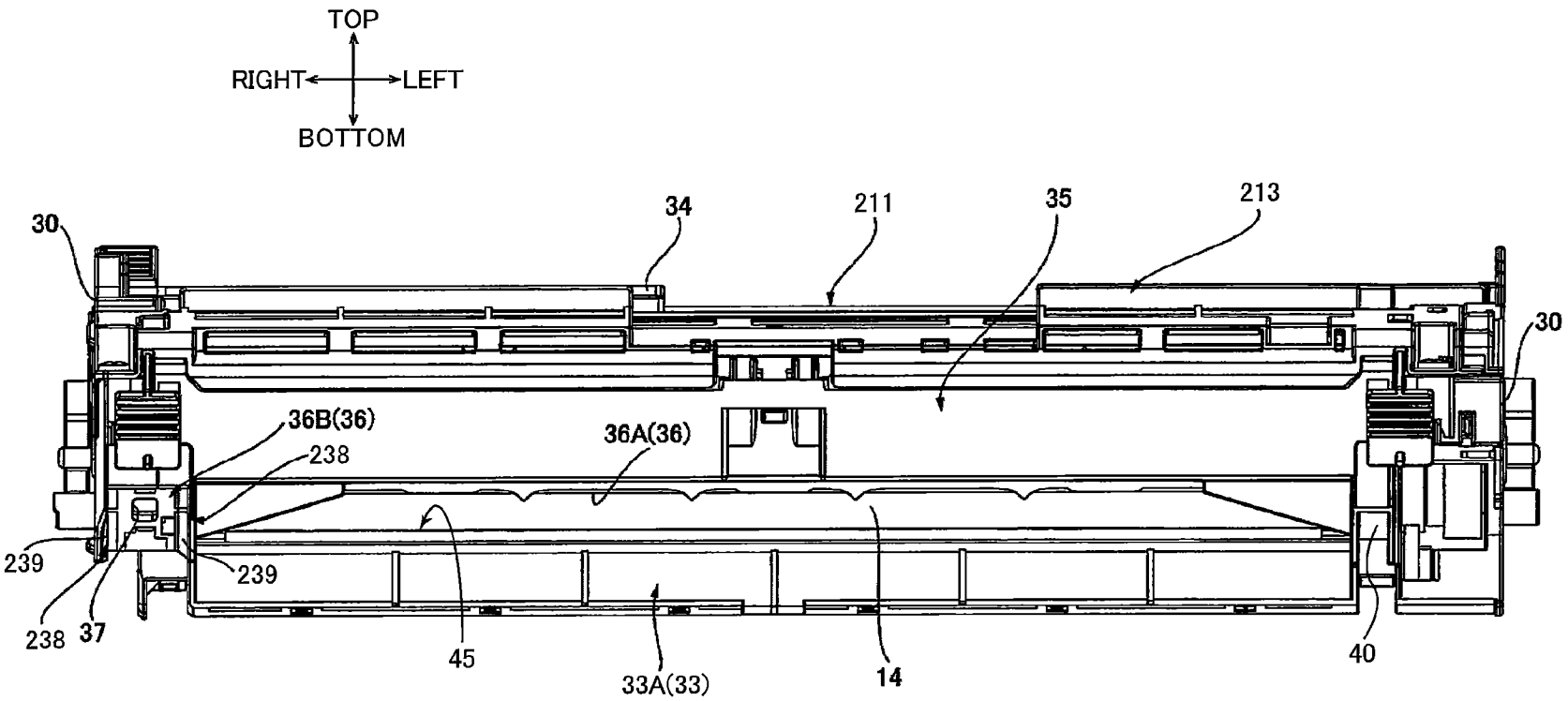
FIG. 10 is a rear view of a drum cartridge provided in a printer according to a second embodiment.
Figure 12A:
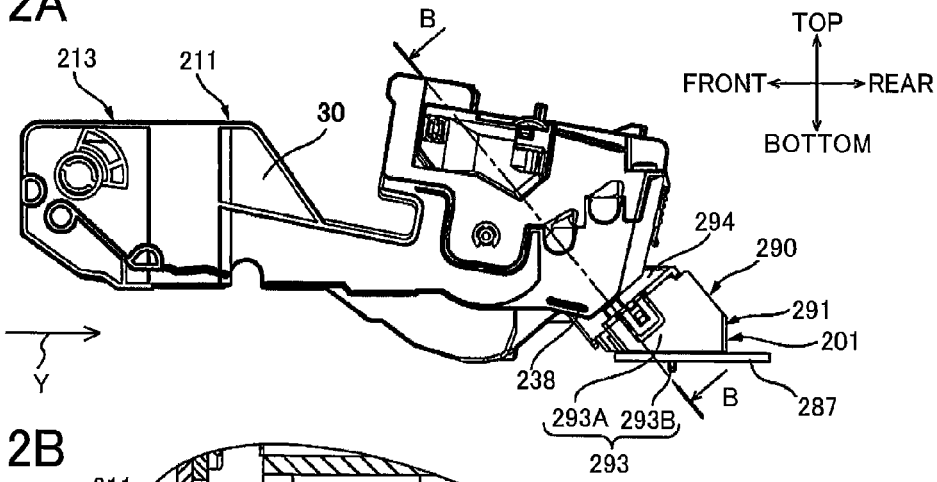
FIG. 12A is a right side view of the drum cartridge shown in FIG. 10 and the light source shown in FIG. 11A.
Figure 12B:
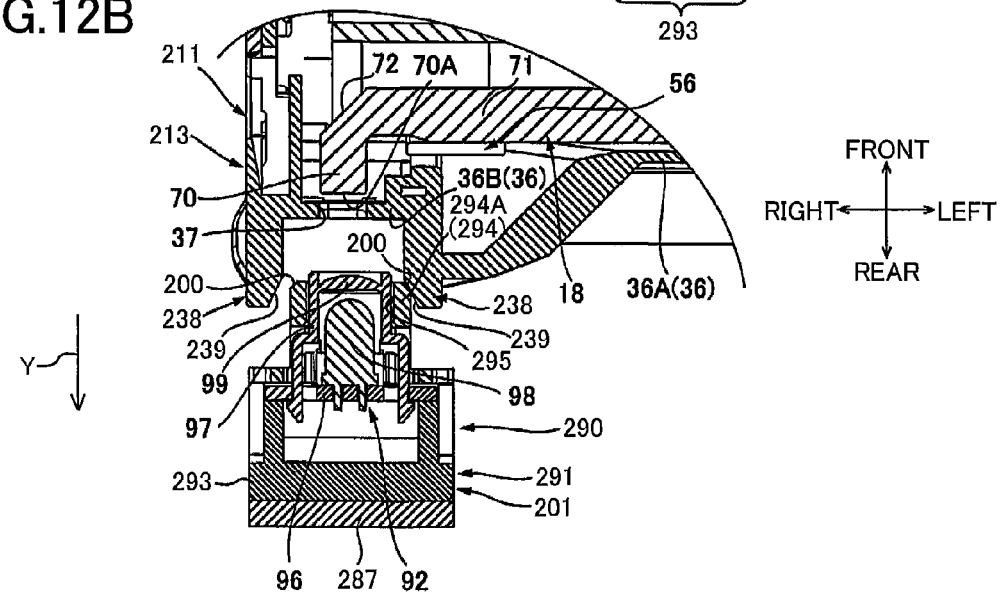
FIG. 12B is a cross-sectional view of the drum cartridge and the light source shown in FIG. 12A taken along a line B-B in FIG. 12A, in which chamfered surfaces of an insertion part of the light source are in contact with sloped surfaces of a pair of ribs provided in the drum cartridge.

As shown in FIG. 10, the pair of ribs 238 (as an example of a first engaging part, a first wall and a second wall, and a pair of wall parts) are provided on the lower rear portion of the drum frame 213 at the right end of the same. Specifically, as shown in FIG. 12A~12C, the ribs 238 are provided on the downstream portion of the drum cartridge 211 with respect to the mounting direction Y of the drum cartridge 211 relative to the main casing 202.

As shown in FIG. 10, the ribs 238 are arranged spaced apart from each other in the left-right direction, with one on either side of the opening 37. As illustrated in FIG. 12A, the ribs 238 have a plate shape that is generally rectangular in a side view. The right rib 238 is integrally formed with the right side frame wall 30, protruding continuously in a direction diagonally downward and rearward from the lower rear edge of the right side frame wall 30.

Figure 12C:
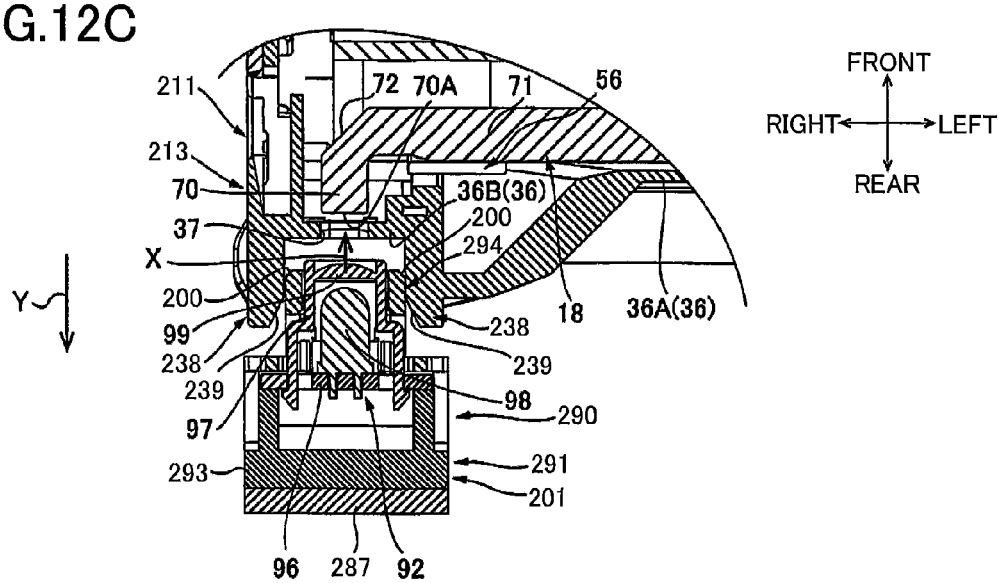
FIG. 12C is a cross-sectional view of the drum cartridge and the light source shown in FIG. 12A taken along a line B-B in FIG. 12A, in which the insertion part of the light source has been inserted into the pair of ribs.

As illustrated in FIG. 12C, the left rib 238 is positioned leftward of and spaced apart from the right rib 238. The left rib 238 is integrally formed with the sloped portion 36B and protrudes in a direction diagonally downward and rearward from the bottom surface of the sloped portion 36B on the left side thereof.

As shown in FIG. 10, each of the ribs 238 has a sloped surface 239 as an example of a first sloped part. The sloped surfaces 239 are formed on the lower rear ends of the corresponding ribs 238 along the inner left-right sides thereof. The sloped surfaces 239 slope inward in the left-right direction from the lower rear edges of the ribs 238 toward the upper front.

Figure 11A:
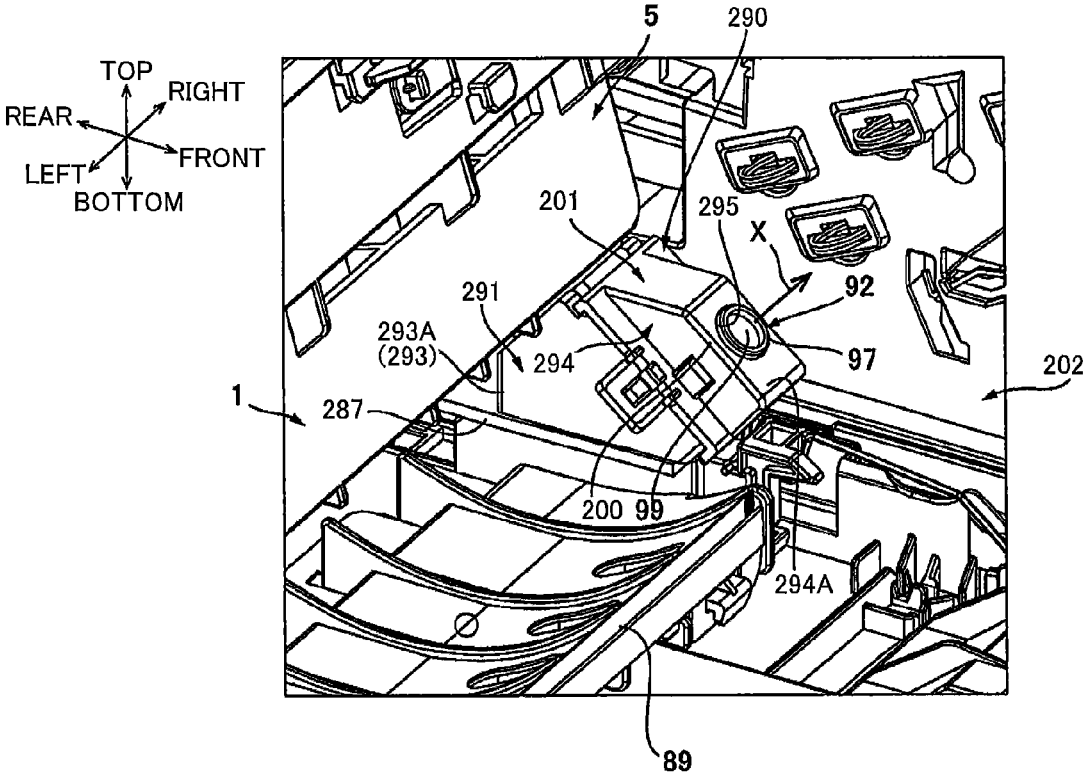
FIG. 11A is a perspective view of a light source provided in the printer according to the second embodiment as viewed from an upper left side thereof.
Figure 11B:
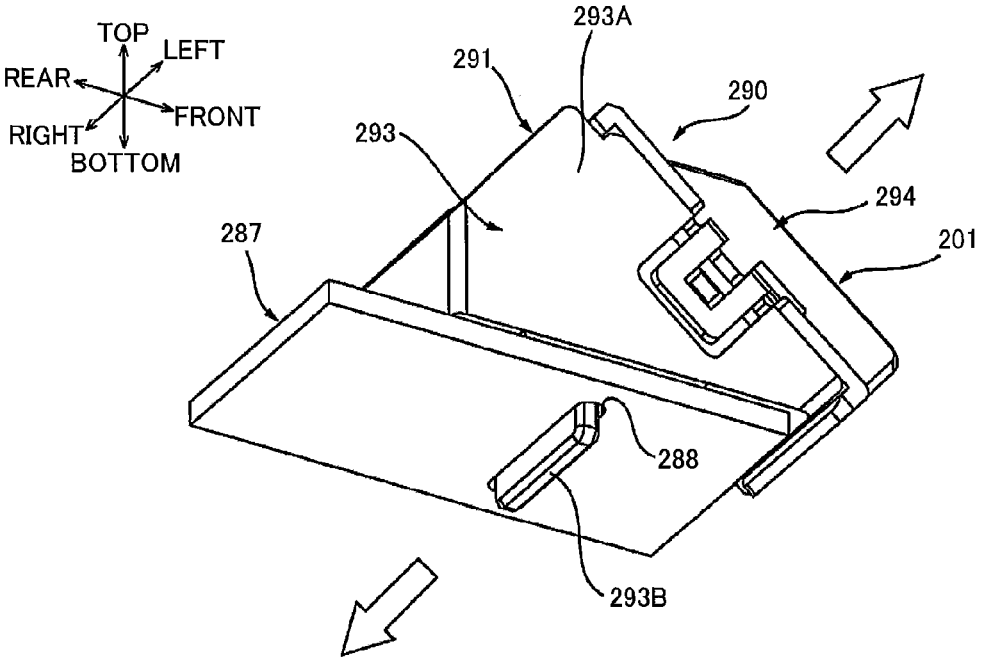
FIG. 11B is a perspective view of the light source shown in FIG. 11A as viewed from a lower left side thereof.

As shown in FIGS. 11A and 11B, the light source 290 is disposed inside the main casing 202 to the right of the conveyance guide 89. The light source 290 is provided with a fixed plate 287, and a movable unit 201.

The fixed plate 287 constitutes the bottom portion of the light source 290. The fixed plate 287 has a plate shape that is generally rectangular in a bottom view and elongated in the front-rear direction. A through-hole 288 is formed in the fixed plate 287. The through-hole 288 is formed in the approximate front-rear center region of the fixed plate 287. The through-hole 288 has a general rectangular shape in a bottom view that is elongated in the left-right direction, and penetrates the fixed plate 287 vertically. The fixed plate 287 is fixed to the main casing 202 so as to be incapable of moving relative thereto.

The movable unit 201 is disposed on the top surface of the fixed plate 287. The movable unit 201 includes a support frame 291 as an example of a support part, and the light emitting unit 92 as an example of an emitting part.

The support frame 91 includes a seat part 293, and an insertion part 294 as an example of a second engaging part.

The seat part 293 constitutes the lower rear portion of the support frame 291. The seat part 293 includes a seat body 293A, and a protruding part 293B.

The seat body 293A has a general quadrangular columnar shape and is elongated in the left-right direction. Specifically, the bottom surface of the seat body 293A extends in the front-rear direction; the upper front surface of the seat body 293A bends and extends diagonally upward and rearward from the front edge on the bottom surface of the seat body 293A; the upper rear surface of the seat body 293A bends and extends diagonally downward and rearward from the top edge on the upper front surface of the seat body 293A; and the rear surface of the seat body 293A bends and extends downward from the bottom edge on the upper rear surface of the seat body 293A and connects to the rear edge on the bottom surface of the seat body 293A.

The seat body 293A has a left-right dimension that is greater than a distance in the left-right direction between the pair of ribs 238.

As shown in FIG. 11B, the protruding part 293B is disposed in the approximate front-rear center region on the bottom surface of the seat body 293A. The protruding part 293B has a general rectangular shape in a bottom view and is elongated in the left-right direction. The protruding part 293B protrudes downward from the bottom surface of the seat body 293A. A front-rear dimension of the protruding part 293B is approximately equal to a front-rear dimension of the through-hole 288. A left-right dimension of the protruding part 293B is smaller than a left-right dimension of the through-hole 288. A vertical dimension of the protruding part 293B is greater than a vertical dimension of the fixed plate 287.

As shown in FIG. 11A, the insertion part 294 constitutes the upper front portion of the support frame 291 and is disposed on the upper front surface of the seat part 293. As shown in FIG. 12C, the insertion part 294 has a box-like shape that is open on the lower rear side. As shown in FIG. 11A, the insertion part 294 has a general rectangular shape in a side view that extends in the direction sloping from the lower front toward the upper rear. As shown in FIG. 12C, a left-right dimension of the insertion part 294 is smaller than the left-right dimension of the seat body 293A and approximately equal to the left-right distance between the pair of ribs 238.

As shown in FIG. 11A, the insertion part 294 has an upper front wall 294A. The upper front wall 294A constitutes the upper front side of the insertion part 294 and has a general plate shape that extends in the direction sloping from the lower front toward the upper rear. The upper front wall 294A has an insertion hole 295, and chamfered surfaces 200 as an example of second sloped parts.

The insertion hole 295 has a general circular shape when viewed from the upper front side and penetrates the upper front wall 294A in the direction sloping from the upper front toward the lower rear.

As shown in FIG. 12B, the chamfered surfaces 200 are formed on both left and right edges of the upper front wall 294A. The chamfered surfaces 200 are beveled edges giving the appearance that the left and right corners of the upper front wall 294A have been chamfered. The chamfered surfaces 200 slope diagonally downward and rearward toward the outer left-right sides from the upper front surface of the upper front wall 294A.

The light emitting unit 92 is accommodated in the insertion part 294. The light emitting unit 92 includes the substrate part 96, the cylindrical part 97, the light emitting part 98, and the lens part 99, and is supported in the support frame 291 such that the upper front end of the cylindrical part 97 is inserted in the insertion hole 295 formed in the insertion part 294 and protrudes slightly downstream of the upper front wall 294A in the emission direction X.

As shown in FIG. 11B, the movable unit 201 is disposed on the top surface of the fixed plate 287 with the protruding part 293B of the seat part 293 inserted into the through-hole 288 of the fixed plate 287.

The protruding part 293B has play in the left-right direction while inserted in the through-hole 288. Accordingly, the movable unit 201 can move left and right according to the degree of play that the protruding part 293B has in the through-hole 288.

<Mounting and Removing Operations of Drum Cartridge Relative to Main Casing>

Next, the operations for mounting the drum cartridge 211 in the main casing 202 and removing the drum cartridge 211 from the main casing 202 will be described.

To mount the drum cartridge 211 in the main casing 202, first the user mounts the developing cartridge 12 in the drum cartridge 211 to configure the process cartridge 3, similar to FIG. 1.

Next, the user inserts the process cartridge 3 into the main casing 202 through the access opening 6. The process cartridge 3 is inserted into the main casing 202 along the mounting direction Y, i.e., in a rearward direction.

If the process cartridge 3 is jiggled in the left-right direction at this time, the sloped surfaces 239 formed on the ribs 238 come into contact with the corresponding chamfered surfaces 200 formed on the insertion part 294. Specifically, if the process cartridge 3 is shifted leftward, the sloped surface 239 formed on the left rib 238 will contact the left chamfered surface 200 on the insertion part 294. Conversely, if the process cartridge 3 is shifted rightward, the sloped surface 239 formed on the right rib 238 will contact the right chamfered surface 200 on the insertion part 294. FIG. 12B illustrates the case in which the process cartridge 3 has been shifted leftward so that the sloped surface 239 of the left rib 238 is in contact with the left chamfered surface 200 on the insertion part 294.

When the user subsequently pushes the process cartridge 3 downstream in the mounting direction Y, the sloped surfaces 239 of the ribs 238 slide over the corresponding chamfered surfaces 200 as the process cartridge 3 moves, and apply pressure to the corresponding chamfered surfaces 200 inward in the left-right direction.

Due to the pressure applied on the chamfered surfaces 200, the movable unit 201 shifts inward in the left-right direction so that the insertion part 294 can be inserted between the ribs 238, as illustrated in FIG. 12C.

In this way, the insertion part 294 becomes interposed between and engaged in the ribs 238. In other words, the sloped surfaces 239 and the chamfered surfaces 200 together guide the engagement of the ribs 238 and the insertion part 294.

The above steps complete the operation for mounting the process cartridge 3 in the main casing 202. Hence, the above steps complete the operation for mounting the drum cartridge 211 in the main casing 202.

While the drum cartridge 211 is mounted in the main casing 202, the light source 290 is positioned on the lower rear side of the sloped portion 36B and ribs 238 provided in the drum cartridge 211. That is, the light source 290 is positioned aligned with and downstream of the sloped portion 36B and ribs 238 in the mounting direction Y, as shown in FIG. 12C.

Further, the insertion part 294 of the light source 290, i.e., the upstream end of the light source 290 with respect to the mounting direction Y is inserted between the ribs 238. With the insertion part 294 interposed between the ribs 238, movement of the movable unit 201 in the left-right direction is restricted.

Further, the sloped portion 36B of the accommodating-section bottom wall 36 confronts but remains spaced apart from the upper front wall 294A of the insertion part 294 in the emission direction X, and the opening 37 in the sloped portion 36B is aligned with the lens part 99 of the light emitting unit 92 in the emission direction X.

Consequently, the first part 70 and the light emitting part 98 are aligned with but spaced apart from each other in the emission direction X, with the opening 37 and the lens part 99 interposed therebetween, while the light emitting unit 92 is positioned downstream of the first part 70 in the mounting direction Y. In other words, the light source 290 is positioned downstream of the light guide 18 in the mounting direction Y.

Since the movable unit 201 is restricted from moving in the left-right direction, the light emitting unit 92 is fixed in position relative to the first part 70 of the light guide 18.

When removing the drum cartridge 211 from the main casing 202, the above steps for mounting the drum cartridge 211 are performed in reverse. Specifically, the user pulls the process cartridge 3 forward through the access opening 6. The drum cartridge 211 passes through the access opening 6 as part of the process cartridge 3 and is removed from the main casing 202. This completes the operation for removing the drum cartridge 211 from the main casing 202.

<Static-Dissipating Operation>

In the second embodiment, the static-eliminating operation is performed to remove residual charge from the circumferential surface of the photosensitive drum 14 in a manner similar to the first embodiment.

<Operational Advantages>

(1) As shown in FIGS. 12B and 12C, the movable unit 201 of the light source 290 is capable of moving in the left-right direction. Hence, the light source 290 can absorb any jiggling in the left-right direction when the drum cartridge 211 is being mounted in the main casing 202, enabling the insertion part 294 of the light source 290 to become reliably engaged in the ribs 238.

When the drum cartridge 211 is mounted in the main casing 202, the engagement between the ribs 238 and the insertion part 294 restrict the left-right movement of the movable unit 201, thereby fixing the position of the light emitting unit 92 relative to the light guide 18. Hence, the structure of the second embodiment can improve the precision in positioning the light source 290 relative to the light guide 18 when the drum cartridge 211 is mounted in the main casing 202.

Further, the light source 290 is disposed downstream of the light guide 18 in the mounting direction Y while the drum cartridge 211 is mounted in the main casing 202. This arrangement allows the printer 1 to be made more compact in the left-right direction than an arrangement that places the light source 290 juxtaposed to the light guide 18 in the left-right direction.

(2) As shown in FIG. 10, the pair of ribs 238 are arranged spaced apart from each other in the left-right direction. Hence, through a simple configuration, the insertion part 294 can be reliably engaged in the ribs 238.

(3) As shown in FIG. 12C, the light source 290 is disposed downstream of the drum cartridge 211 in the mounting direction Y when the drum cartridge 211 is mounted in the main casing 202. Further, the ribs 238 are provided on the downstream portion of the drum cartridge 211 with respect to the mounting direction Y.

Accordingly, when the drum cartridge 211 is mounted in the main casing 202, the insertion part 294 of the light source 290 can be reliably engaged between the ribs 238.

(4) As shown in FIG. 10, the pair of ribs 238 are provided on the drum frame 213 that supports the light guide 18. This arrangement ensures that the relative positions of the ribs 238 and the light guide 18 are maintained constant.

Thus, this construction reliably improves the precision in positioning the light guide 18 relative to the light source 290 when the insertion part 294 is engaged in the ribs 238, as illustrated in FIG. 12C.

(5) As shown in FIG. 12C, the insertion part 294 is provided on the support frame 291 that supports the light emitting unit 92. Accordingly, this construction ensures that the relative positions of the insertion part 294 and light emitting unit 92 are maintained constant.

Thus, this construction can even more reliably improve the precision in positioning the light emitting unit 92 relative to the light guide 18 when the insertion part 294 is engaged in the ribs 238.

(6) When mounting the drum cartridge 211 in the main casing 202, the sloped surfaces 239 formed on the ribs 238 guide the engagement of the insertion part 294 with the ribs 238, as illustrated in FIG. 12B. Hence, this configuration can ensure smooth engagement of the insertion part 294 in the ribs 238.

(7) When mounting the drum cartridge 211 in the main casing 202, the chamfered surfaces 200 formed on the insertion part 294 guide the engagement of the insertion part 294 with the ribs 238, as illustrated in FIG. 12B. Accordingly, this configuration can ensure even smoother engagement of the insertion part 294 and the ribs 238.

(8) As shown in FIG. 5B, the first part 70 of the light guide 18 guides light emitted from the light source 290 along the emission direction X, and the light-path converting surface 72 changes the direction of light passing through the first part 70 to a direction toward the second part 71. Subsequently, the second part 71 of the light guide 18 guides light passing therethrough toward the surface of the photosensitive drum 14, as illustrated in FIG. 4, to remove charge from the surface of the photosensitive drum 14.

Thus, even though the light source 290 is disposed downstream of the light guide 18 in the mounting direction Y when the drum cartridge 211 is mounted in the main casing 202, light emitted from the light source 290 can be made to remove charge from the surface of the photosensitive drum 14 by arranging the first part 70 of the light guide 18 aligned with the light source 290 in the emission direction X.

Accordingly, this arrangement can reliably remove charge from the surface of the photosensitive drum 14 while enabling the printer 1 to be made more compact in the left-right dimension.

3. Third Embodiment

Next, a third embodiment of the present invention will be described while referring to FIGS. 13A through 13C, wherein like parts and components are designated with the same reference numerals to avoid duplicating description. In the following description, only parts differing from those of the above embodiments will be described in detail.

In the third embodiment, a light source 390 provided in a main casing 302 includes a fixed part 331, a spring member 312, and a movable unit 320.

Figures 13A, 13B, 13C:
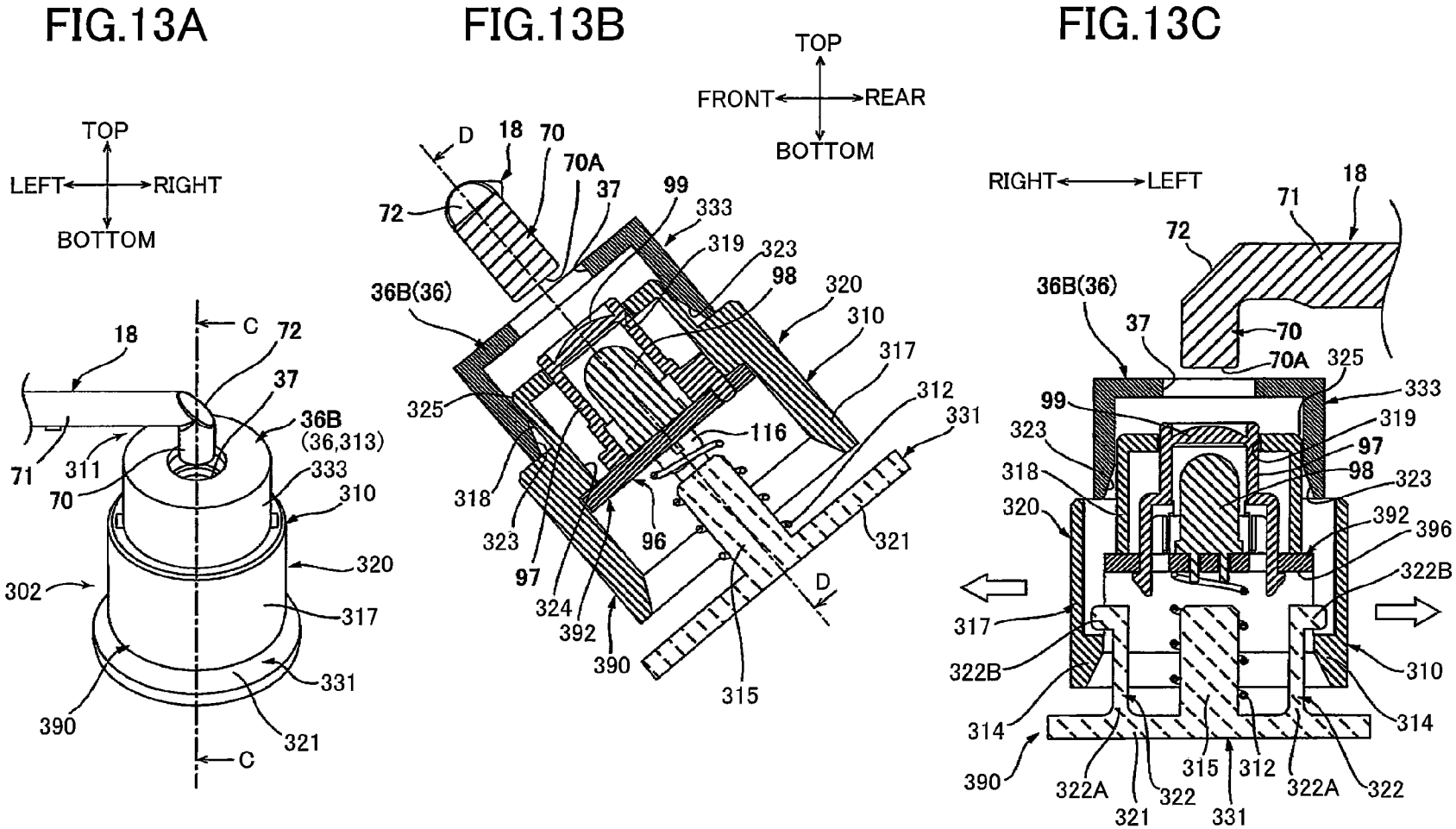
FIG. 13A is a perspective view of a light source and a light guide provided in a printer according to a third embodiment as viewed from an upper front side thereof.
FIG. 13B is a cross-sectional view of the light source and the light guide shown in FIG. 13A taken along a line C-C in FIG. 13A.
FIG. 13C is a cross-sectional view of the light source and the light guide shown in FIG. 13A taken along a line D-D in FIG. 13B.

As shown in FIGS. 13B and 13C, the fixed part 331 constitutes the lower rear portion of the light source 390. The fixed part 331 is integrally formed of a fixed plate 321, a shaft part 315, and a pair of restricting parts 322.

The fixed plate 321 has a general disc shape and is oriented in the direction sloping from the lower front toward the upper rear, as illustrated in FIG. 13B. The fixed plate 321 is fixed to the main casing 302 so as to be incapable of moving relative thereto.

The shaft part 315 is disposed on the upper front surface of the fixed plate 321. The shaft part 315 has a general columnar shape whose axis is oriented in the direction sloping from the upper front toward the lower rear. The shaft part 315 extends diagonally upward and forward from the approximate radial center region of the fixed plate 321.

As shown in FIG. 13C, the restricting parts 322 are arranged on the upper front surface of the fixed plate 321, with one on each of the left and right sides of the shaft part 315 and spaced apart from the shaft part 315. The restricting parts 322 have a plate shape that is generally L-shaped in a side view. Each restricting part 322 is integrally formed of a body part 322A, and a restricting protrusion 322B. The body part 322A extends diagonally upward and forward from the fixed plate 321. The restricting protrusion 322B protrudes outward in the left-right direction from the upper front end of the body part 322A.

As shown in FIG. 13B, the spring member 312 has an air-core coil structure with its axis oriented in the direction sloping from the upper front toward the lower rear. The spring member 312 has an inner diameter approximately equal to an outer diameter of the shaft part 315. The spring member 312 is supported on the fixed part 331 by inserting the shaft part 315 into the spring member 312 through the lower rear end of the spring member 312.

The movable unit 320 constitutes the upper front portion of the light source 390. The movable unit 320 includes a support frame 310, and the light emitting unit 392.

The support frame 310 has a general cylindrical shape, with its axis oriented in the direction sloping from the upper front toward the lower rear. The support frame 310 is integrally formed of a large-diameter part 317, and a small-diameter part 318 as an example of a second engaging part.

The large-diameter part 317 constitutes the lower rear portion of the support frame 310 and has a general cylindrical shape whose axis is oriented in the direction sloping from the upper front toward the lower rear. The upper front end of the large-diameter part 317 is closed. As shown in FIGS. 13B and 13C, the large-diameter part 317 includes a communication hole 324, and a pair of anchoring parts 314.

As shown in FIG. 13B, the communication hole 324 is formed in the approximate radial center region in the upper front end portion of the large-diameter part 317. The communication hole 324 has a general circular shape when viewed from the upper front side and penetrates the upper front end of the large-diameter part 317 in the direction sloping from the upper front toward the lower rear.

As shown in FIG. 13C, the anchoring parts 314 are disposed on the lower rear portion of the inner circumferential surface of the large-diameter part 317. The anchoring parts 314 confront but are spaced apart from each other in the left-right direction. The anchoring parts 314 have a general rectangular cross-section and protrude radially inward from the inner circumferential surface of the large-diameter part 317.

As shown in FIG. 13B, the small-diameter part 318 constitutes the upper front portion of the support frame 310. The small-diameter part 318 has a general cylindrical shape that is coaxially arranged with the large-diameter part 317. The small-diameter part 318 extends diagonally upward and forward from the peripheral edge of the communication hole 324 on the upper front end of the large-diameter part 317. An outer diameter of the small-diameter part 318 is smaller than an outer diameter of the large-diameter part 317. The upper front end of the small-diameter part 318 is closed. The small-diameter part 318 has a through-hole 319, and a chamfered surface 325 as an example of a second sloped surface.

The through-hole 319 is formed in the approximate radial center region in the upper front end of the small-diameter part 318. The through-hole 319 has a general circular shape when viewed from the upper front side and penetrates the upper front end of the small-diameter part 318 in the direction sloping from the upper front toward the lower rear.

The chamfered surface 325 is formed on the outer radial edge along the upper front end of the small-diameter part 318. The chamfered surface 325 is a beveled surface that appears as if the upper front end of the small-diameter part 318 has been chamfered along its outer radial edge, so as to slope diagonally downward and rearward toward the outer radial side from the upper front surface of the small-diameter part 318.

The light emitting unit 392 includes a substrate part 396, the cylindrical part 97, the light emitting part 98, and the lens part 99.

The light emitting unit 392 is accommodated in the support frame 310 with the upper front end of the cylindrical part 97 inserted into the through-hole 319.

The substrate part 396 of the light emitting unit 392 has a general disc shape, with an outer diameter approximately equal to the inner diameter of the large-diameter part 317. The substrate part 396 includes a protruding part 316.

The protruding part 316 is disposed in the approximate radial center region on the lower rear surface of the substrate part 396. The protruding part 316 has a general columnar shape and protrudes diagonally downward and rearward from the lower rear surface of the substrate part 396. An outer diameter of the protruding part 316 is approximately equal to an outer diameter of the shaft part 315.

The movable unit 320 is supported on the fixed part 331 through the spring member 312 by inserting the protruding part 316 through the upper front end of the spring member 312. With this configuration, the spring member 312 constantly urges the movable unit 320 diagonally upward and forward.

As shown in FIG. 13C, the anchoring parts 314 are disposed diagonally downward and rearward of the restricting protrusions 322B on the corresponding restricting parts 322, and the inner circumferential surface of the large-diameter part 317 is spaced apart from the restricting protrusions 322B in the radial direction of the large-diameter part 317. Thus, the movable unit 320 is capable of moving left and right according to the amount of gap (play) between the inner circumferential surface of the large-diameter part 317 and the restricting protrusions 322B.

Further, a drum frame 313 of a drum cartridge 311 also has an engaging cylinder 333 as an example of a first engaging part that is positioned over the small-diameter part 318.

As shown in FIG. 13B, the engaging cylinder 333 is disposed on the lower rear surface of the sloped portion 36B formed on the drum frame 313. The engaging cylinder 333 has a general cylindrical shape whose axis is oriented in the direction sloping from the upper front toward the lower rear. The engaging cylinder 333 protrudes diagonally downward and rearward from the sloped portion 36B so as to surround the opening 37 when viewed from the lower rear side. An inner diameter of the engaging cylinder 333 is approximately equal to the outer diameter of the small-diameter part 318. An outer diameter of the engaging cylinder 333 is smaller than the outer diameter of the large-diameter part 317. The engaging cylinder 333 has a guide surface 323 as an example of a first sloped surface.

The guide surface 323 is formed on the inner circumferential surface of the engaging cylinder 333 at the lower rear end thereof. The guide surface 323 slopes radially inward toward the upper front side from the lower rear edge of the engaging cylinder 333.

In the third embodiment described above, if the drum cartridge 311 is jiggled in the left-right direction while being mounted in the main casing 302, similar to FIG. 1, the guide surface 323 of the engaging cylinder 333 contacts the chamfered surface 325 formed on the small-diameter part 318.

As the drum cartridge 311 continues to move into the main casing 302, the guide surface 323 of the engaging cylinder 333 slides over the chamfered surface 325 formed on the small-diameter part 318 while pressing the chamfered surface 325 inward in the left-right direction.

Consequently, the movable unit 320 of the light source 390 moves inward in the left-right direction, and the small-diameter part 318 is inserted into the engaging cylinder 333, as shown in FIG. 13C. Accordingly, the engaging cylinder 333 restricts the small-diameter part 318 from moving in its radial direction. In other words, the guide surface 323 and the chamfered surface 325 guide the engagement of the engaging cylinder 333 and the small-diameter part 318.

In this way, the light emitting unit 392 can be fixed in position relative to the first part 70 of the light guide 18. Accordingly, the third embodiment described above can obtain the same operational advantages described above in the second embodiment.

Further, the spring member 312 urges the movable unit 320 diagonally upward and forward so that the upper front end of the large-diameter part 317 is in contact with the lower rear end of the engaging cylinder 333. Accordingly, this construction can even better improve the precision in positioning the light emitting unit 392 and the light guide 18 relative to each other.

4. Fourth Embodiment

Next, a fourth embodiment of the present invention will be described while referring to FIGS. 14A and 14B, wherein like parts and components are designated with the same reference numerals to avoid duplicating description. In the following description, only parts differing from those of the embodiment will be described in detail.

In the fourth embodiment, a light guide 418 supported in a light-guide support part 456 of a drum cartridge 411 is capable of moving in the left-right direction.

Specifically, the light-guide support part 456 is provided with a side plate part 428, and the second part 71 of the light guide 418 is positioned to the right of and spaced apart from the side plate part 428.

The side plate part 428 constitutes the left end of the light-guide support part 456 and closes this left end. The light guide 418 is supported in the light-guide support part 456 such that the left endface of the second part 71 confronts but is spaced apart from the side plate part 428 in the left-right direction, forming a gap S in the left-right direction between the left endface of the second part 71 and the side plate part 428.

Thus, the light guide 418 is capable of moving in the left-right direction by a distance equivalent to the gap S.

Note that a dimension of a first part 470 of the light guide 418 along the direction sloping from the upper front toward the lower rear is larger than that of the first part 70 of the light guide 18 described in the above embodiments. The first part 470 is inserted through an opening 437 formed in the sloped portion 36B. Further, the opening 437 has a dimension sufficient for allowing the first part 470 to move in a left-right direction.

On the other hand, a light source 490 is fixed to a main casing 402 so as to be incapable of moving relative thereto. Further, an insertion part 494 of the light source 490 has an insertion hole 427 as an example of a second engaging part, and a guide surface 426 as an example of a second sloped part.

The insertion hole 427 is formed in an upper front wall 494A of the insertion part 494. The insertion hole 427 has an elliptical shape that is elongated vertically when viewed from the upper front side and penetrates the upper front wall 494A in the direction sloping from the upper front toward the lower rear. A minor axis of the insertion hole 427 is approximately equal to an outer diameter of the first part 470, while a major axis of the insertion hole 427 is greater than the outer diameter of the first part 470.

The guide surface 426 is formed on the upper front wall 494A along the peripheral edge of the insertion hole 427. The guide surface 426 slopes diagonally downward and rearward toward the radial inside of the insertion hole 427 from the peripheral edge of the same.

In the fourth embodiment described above, if the drum cartridge 411 is jiggled in the left-right direction due to play while being mounted in the main casing 402, similar to FIG. 1, the lower rear end of the first part 470 constituting the light guide 418 contacts the guide surface 426 formed on the upper front wall 494A of the insertion part 494.

As the drum cartridge 411 continues to move into the main casing 402, the guide surface 426 slides over the lower rear end of the first part 470 while pressing the first part 470 inward in the left-right direction.

Figure 14A:
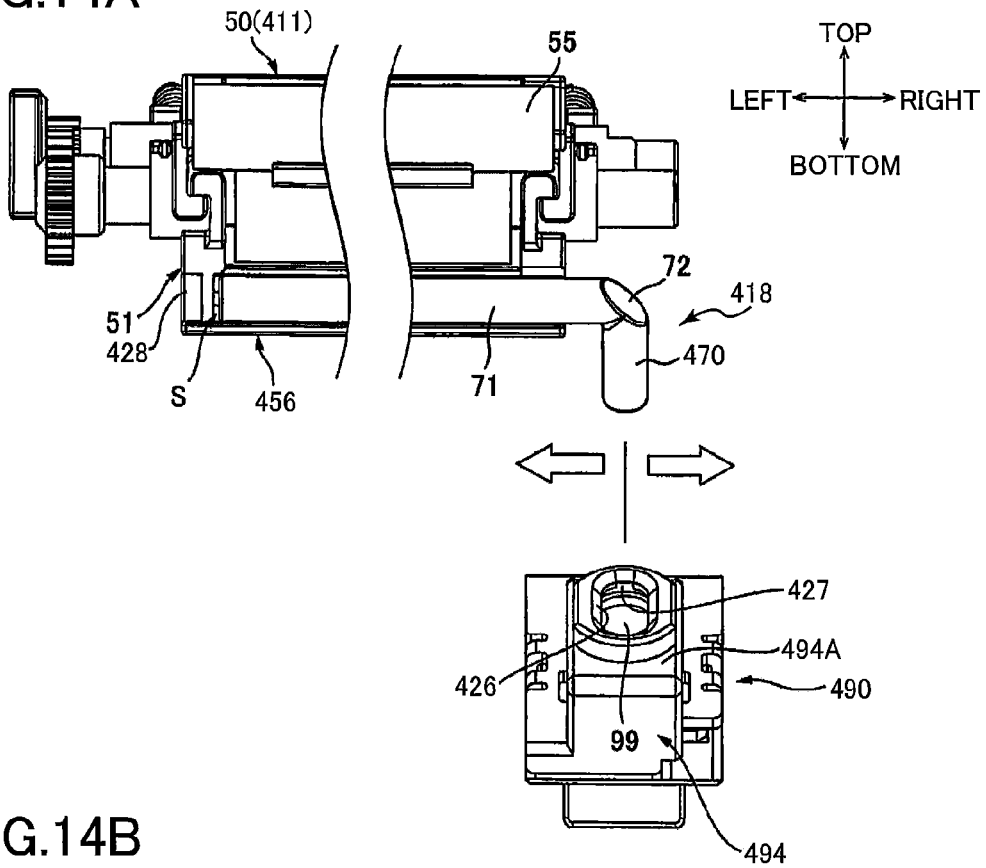
FIG. 14A is a perspective view of a light source and a light guide provided in a printer according to a fourth embodiment as viewed from an upper front side thereof.
Figure 14B:
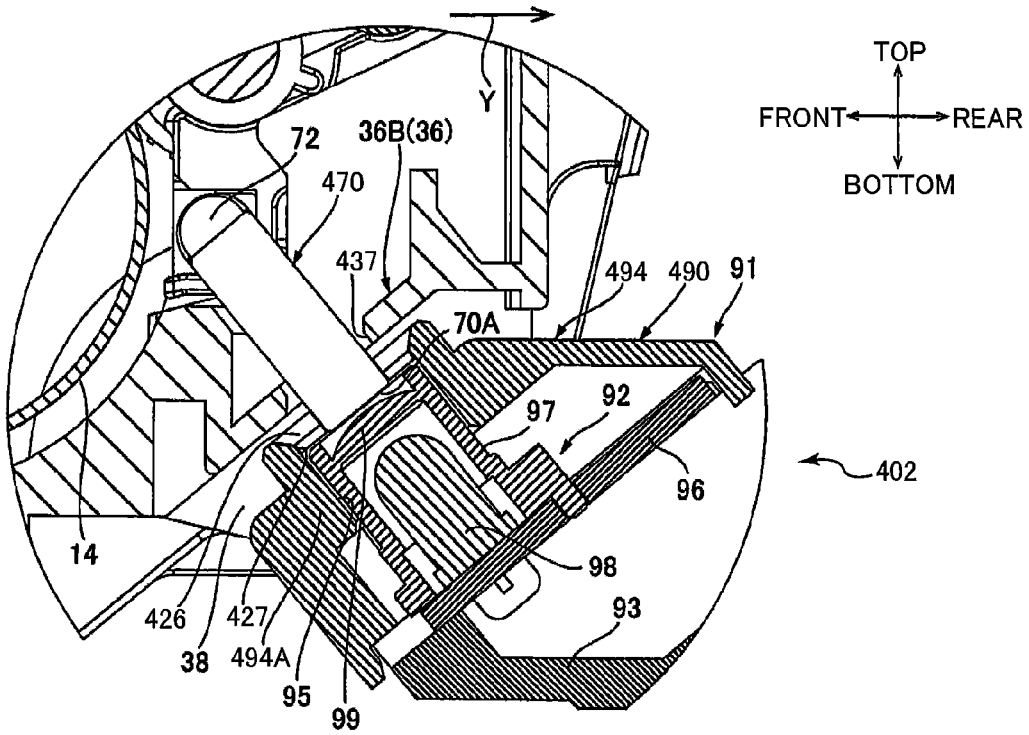
FIG. 14B is a side cross-sectional view of the light source and the light guide shown in FIG. 14A in a state where a drum cartridge has been mounted in a main casing.

Consequently, the light guide 418 is shifted in the left-right direction so that the lower rear end of the first part 470 can be inserted into the insertion hole 427, as illustrated in FIG. 14B. At this time, the first part 470 is engaged with the left and right edges defining the insertion hole 427. Hence, the left and right edges of the insertion hole 427 restrict left and right movement of the first part 470. Thus, the first part 470 acts as an example of a first engaging part, and the guide surface 426 guides the engagement of the first part 470 and the peripheral edge of the insertion hole 427.

Through this construction, the first part 470 of the light guide 418 can be fixed in position relative to the light emitting unit 92.

As shown in FIG. 14A, the light guide 418 is capable of moving in the left-right direction. Accordingly, if the drum cartridge 411 is jiggled left or right due to play while being mounted in the main casing 402, the light guide 418 can absorb this play, ensuring that the first part 470 is reliably engaged with the peripheral edge of the insertion hole 427.

Thus, when the drum cartridge 411 is mounted in the main casing 402, the engagement between the first part 470 and the peripheral edge of the insertion hole 427 restrict left-right movement of the light guide 418, thereby fixing the position of the light guide 418 relative to the light emitting unit 92. Hence, the structure of the fourth embodiment can improve the precision in positioning the light guide 418 relative to the light emitting unit 92 when the drum cartridge 411 is mounted in the main casing 402.

As shown in FIG. 14A, the insertion part 494 has the guide surface 426. The guide surface 426 guides the engagement of the first part 470 and the peripheral edge of the insertion hole 427 when the drum cartridge 411 is mounted in the main casing 402. Hence, the guide surface 426 can more smoothly engage the first part 470 with the peripheral edge of the insertion hole 427.

Further, the first part 470 of the light guide 418 is disposed on a downstream portion of the drum cartridge 411 with respect to the mounting direction Y, as shown in FIG. 14B. Accordingly, the first part 470 can be reliably inserted into the insertion hole 427 of the insertion part 494 by mounting the drum cartridge 411 in the main casing 402.

Accordingly, the fourth embodiment described above can obtain the same operational advantages described above in the second and third embodiments.

Figure 15:
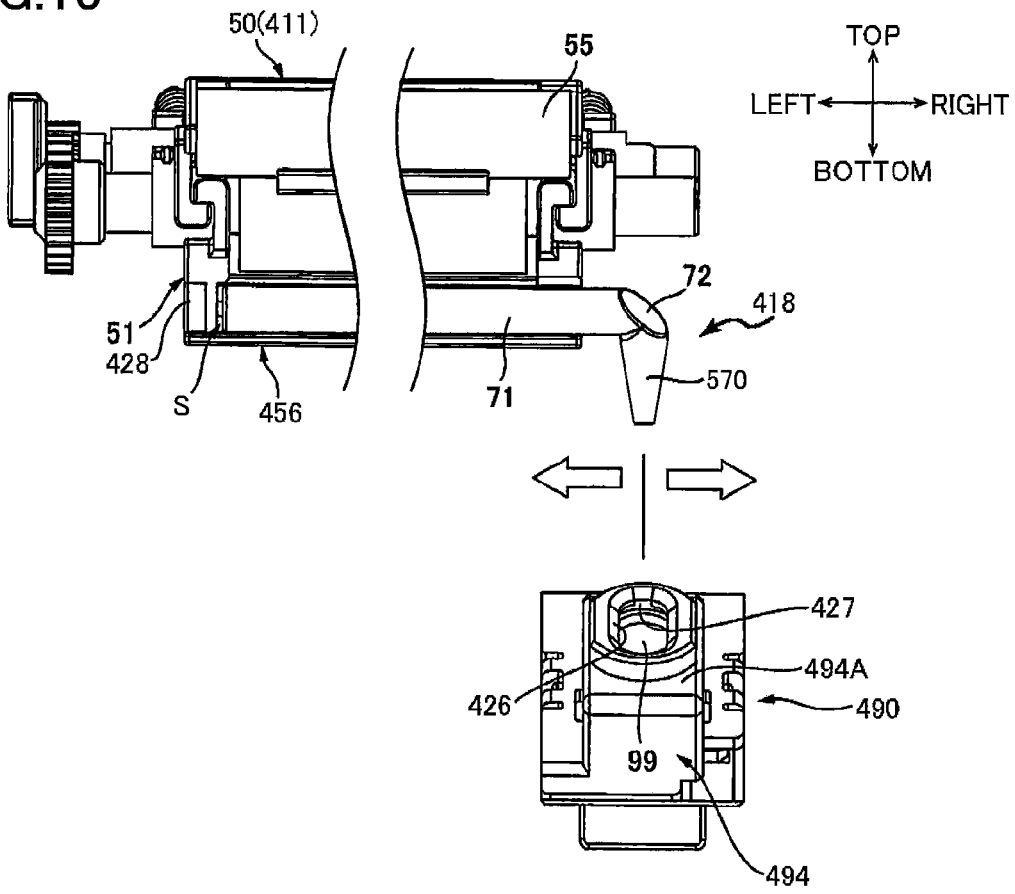
FIG. 15 is a perspective view showing a variation of the light guide according to the fourth embodiment.

Incidentally, as shown in FIG. 15, the light guide 418 may have a first part 570 in place of the first part 470. The first part 570 has a general tapered columnar shape that extends along the direction sloping from the upper front toward the lower rear. More specifically, the first part 570 is tapered toward the lower rear. The first part 570 serves as an example of a first engaging part, and a circumferential surface of the first part 570 serves as an example of a first sloped part. Both the circumferential surface of the first part 570 and the guide surface 426 guide the engagement of the first part 570 and the peripheral edge of the insertion hole 427. Note that, in case the first part 570 is provided in the light guide 418, the guide surface 426 may be dispensed with.

5. Variations of First Through Fourth Embodiments

In the embodiments described above, the process cartridge 3 is configured of the drum cartridge 11 (211, 311, 411), and the developing cartridge 12 that is detachably mounted in the drum cartridge 11. However, the process cartridge 3 may be integrally configured of the drum cartridge 11 (211, 311, 411) and the developing cartridge 12. In this case, the process cartridge 3 serves as an example of a photosensitive body cartridge.

Further, a photosensitive belt or the like may be used in place of the photosensitive drum 14 described above.

Any of these variations can obtain the same operational advantages described above in the embodiments. Note that the first through fourth embodiments and their variations described above may also be combined when appropriate.

While the description has been made in detail with reference to the embodiments thereof, it would be apparent to those skilled in the art that many modifications and variations may be made therein without departing from the scope of the disclosure.

What is claimed is:

1. An image forming apparatus comprising:

a main casing;

a light source provided in the main casing and configured to emit a light; and a photosensitive cartridge configured to be mounted in the main casing in a mounting direction, the photosensitive cartridge comprising:

a photosensitive drum having a surface and an axis extending in an axial direction, the axial direction crossing the mounting direction;

a light guide configured to guide the light emitted from the light source to the surface of the photosensitive drum to eliminate static on the surface of the photosensitive drum;

a first wall; and a second wall positioned to face the first wall in the axial direction such that an imaginary line extending in the axial direction and passing through the first wall passes through the second wall, the second wall thereby being positioned to overlap the first wall when viewed in the axial direction, the light source being disposed between the first wall and the second wall when viewed along the imaginary line in the axial direction, and when the photosensitive cartridge has been mounted in the main casing.

2. The image forming apparatus as claimed in claim 1, wherein the light source has an upstream end portion in the mounting direction, the upstream end portion being disposed between the first wall and the second wall when the photosensitive cartridge has been mounted in the main casing.

3. The image forming apparatus as claimed in claim 1, wherein the light guide comprises a light receiving part configured to receive the light emitted from the light source, the light receiving part being disposed between the first wall and the second wall when the photosensitive cartridge has been mounted in the main casing.

4. The image forming apparatus as claimed in claim 1, wherein the light source comprises:

an emitting part configured to emit the light in a direction that crosses the axial direction; and a support part configured to support the emitting part, and wherein the emitting part is disposed between the first wall and the second wall.

5. The image forming apparatus as claimed in claim 1, wherein the photosensitive cartridge further comprises a cartridge frame configured to support the photosensitive drum, the first wall and the second wall being integral with the cartridge frame.

6. The image forming apparatus as claimed in claim 5, wherein the cartridge frame has an opening formed at a position between the light guide and the light source when the photosensitive cartridge has been mounted in the main casing, the opening allowing the light emitted from the light source to pass therethrough, and wherein the photosensitive cartridge further comprises a transmissive member configured to transmit light and disposed to cover the opening.

7. An image forming apparatus comprising:

a main casing;

a light source provided in the main casing and comprising:

an emitting part configured to emit a light in an emission direction; and a support part configured to support the emitting part;

a photosensitive cartridge configured to be mounted in the main casing in a mounting direction, the photosensitive cartridge comprising:

a photosensitive drum having a surface;

a light guide configured to guide the light emitted from the emitting part to the surface of the photosensitive drum to eliminate static on the surface of the photosensitive drum; and a cartridge frame configured to support the photosensitive drum; and a cover member provided separately from the main casing and the photosensitive cartridge, the cover member being positioned to surround the emitting part as viewed in the emission direction, the cover member being configured to contact both the support part and the cartridge frame to seal a gap between the support part and the cartridge frame when the photosensitive cartridge has been mounted in the main casing.

8. The image forming apparatus as claimed in claim 7, wherein the cover member protrudes further downstream in the emission direction than the emitting part.

9. The image forming apparatus as claimed in claim 7, wherein the cover member is supported at the light source.

10. The image forming apparatus as claimed in claim 9, wherein the cover member comprises an elastic member.

11. The image forming apparatus as claimed in claim 7, wherein the cover member is supported at the photosensitive cartridge.

12. The image forming apparatus as claimed in claim 11, wherein the cover member comprises an elastic member.

13. The image forming apparatus as claimed in claim 7, wherein the light source is arranged juxtaposed to the photosensitive cartridge in the mounting direction when the photosensitive cartridge has been mounted in the main casing.

14. The image forming apparatus as claimed in claim 7, wherein the emitting part is configured to emit the light upward.

15. The image forming apparatus as claimed in claim 7, wherein the cartridge frame has an opening formed at a position between the light guide and the light emitting portion when the photosensitive cartridge has been mounted in the main casing, the opening allowing the light emitted from the light source to pass therethrough, and wherein the photosensitive cartridge further comprises a transmissive member configured to transmit the light and disposed to cover the opening.

16. An image forming apparatus comprising:

a main casing;

a light source provided in the main casing and configured to emit a light; and a photosensitive cartridge configured to be mounted in the main casing in a mounting direction, the photosensitive cartridge comprising:

a first engaging part;

a photosensitive drum extending in an orthogonal direction that is orthogonal to the mounting direction, the photosensitive drum having a surface; and a light guide configured to guide the light emitted from the light source to the surface of the photosensitive drum to eliminate static on the surface of the photosensitive drum, wherein the light source is configured to move in the orthogonal direction, the light source being disposed downstream of the light guide in the mounting direction when the photosensitive cartridge has been mounted in the main casing, the light source comprising a second engaging part configured to engage with the first engaging part when the photosensitive cartridge is mounted in the main casing, and wherein the first engaging part is configured to restrict the movement of the light source in the orthogonal direction upon engagement with the second engaging part to fix relative positions between the light guide and the light source.

17. The image forming apparatus as claimed in claim 16, wherein the first engaging part comprises a pair of wall parts arranged spaced apart from each other in the orthogonal direction.

18. The image forming apparatus as claimed in claim 16, wherein the light source is positioned downstream of the photosensitive cartridge in the mounting direction when the photosensitive cartridge has been mounted in the main casing, and wherein the photosensitive cartridge has a downstream portion in the mounting direction, the first engaging part being provided at the downstream portion.

19. The image forming apparatus as claimed in claim 16, wherein the photosensitive cartridge further comprises a cartridge frame configured to support the photosensitive drum and the light guide, the first engaging part being provided at the cartridge frame.

20. The image forming apparatus as claimed in claim 16, wherein the light source further comprises:

an emitting part configured to emit the light; and a support part configured to support the emitting part, and wherein the second engaging part is provided at the support part.

21. The image forming apparatus as claimed in claim 16, wherein the first engaging part includes a first sloped part configured to guide the engagement of the first engaging part and the second engaging part.

22. The image forming apparatus as claimed in claim 16, wherein the second engaging part includes a second sloped part configured to guide the engagement of the first engaging part and the second engaging part.

23. The image forming apparatus as claimed in claim 16, wherein the light guide comprises:

a first part extending in a direction that crosses the orthogonal direction and configured to receive the light emitted from the light source;

a second part extending in the orthogonal direction and disposed to face the photosensitive drum; and a third part disposed between the first part and the second part, the third part being configured to change a direction of the light passing through the first part so as to guide the light toward the second part.

24. An image forming apparatus comprising:

a main casing;

a light source provided in the main casing and configured to emit a light; and a photosensitive cartridge configured to be mounted in the main casing in a mounting direction, the photosensitive cartridge comprising:

a photosensitive drum extending in an orthogonal direction that is orthogonal to the mounting direction, the photosensitive drum having a surface; and a light guide configured to guide the light emitted from the light source to the surface of the photosensitive drum to eliminate static on the surface of the photosensitive drum, the light guide being configured to move in the orthogonal direction and comprising a first engaging part, wherein the light source comprises a second engaging part configured to engage with the first engaging part when the photosensitive cartridge is mounted in the main casing, the second engaging part is configured to restrict the movement of the light guide in the orthogonal direction upon engagement with the first engaging part to fix relative positions between the light guide and the light source.

25. The image forming apparatus as claimed in claim 24, wherein the light source further comprises:

an emitting part configured to emit the light; and a support part configured to support the emitting part, wherein the second engaging part is provided at the support part.

26. The image forming apparatus as claimed in claim 24, wherein the first engaging part includes a first sloped part configured to guide the engagement of the first engaging part and the second engaging part.

27. The image forming apparatus as claimed in claim 24, wherein the second engaging part includes a second sloped part configured to guide the engagement of the first engaging part and the second engaging part.

28. The image forming apparatus as claimed in claim 24, wherein the light source is positioned downstream of the photosensitive cartridge in the mounting direction when the photosensitive cartridge has been mounted in the main casing, and wherein the photosensitive cartridge has a downstream portion in the mounting direction, the first engaging part being disposed at the downstream portion.

29. The image forming apparatus as claimed in claim 28, wherein the light guide comprises:

a first part extending in a direction that crosses the orthogonal direction and configured to receive the light emitted from the light source;

a second part extending in the orthogonal direction and disposed to face the photosensitive drum; and a third part disposed between the first part and the second part, the third part being configured to change a direction of the light passing through the first part so as to guide the light toward the second part.

* * * * *